US006812200B2

(12) United States Patent
Weber et al.

(10) Patent No.: US 6,812,200 B2
(45) Date of Patent: Nov. 2, 2004

(54) PROCESS FOR COATING DETERGENT TABLETS

(75) Inventors: Henriette Weber, Duesseldorf (DE); Georg Assmann, Juechen (DE)

(73) Assignee: Henkel Kommanditgesellschaft auf Aktien, Duesseldorf (DE)

( * ) Notice: Subject to any disclaimer, the term of this patent is extended or adjusted under 35 U.S.C. 154(b) by 32 days.

(21) Appl. No.: 10/602,001

(22) Filed: Jun. 23, 2003

(65) Prior Publication Data

US 2004/0014631 A1 Jan. 22, 2004

Related U.S. Application Data

(63) Continuation of application No. PCT/EP01/14783, filed on Dec. 14, 2001.

(30) Foreign Application Priority Data

Dec. 23, 2000 (DE) ..... 100 64 985

(51) Int. Cl.[7] ..... C11D 11/00

(52) U.S. Cl. ..... 510/441; 510/442; 510/446; 510/224; 510/294; 510/298

(58) Field of Search ..... 510/441, 442, 510/446, 294, 298, 224

(56) References Cited

U.S. PATENT DOCUMENTS

| | | | | |
|---|---|---|---|---|
| 3,234,258 A | | 2/1966 | Morris | 558/42 |
| 3,451,928 A | * | 6/1969 | Fischer | 510/298 |
| 3,836,537 A | | 9/1974 | Boerwinkle et al. | 524/548 |
| 4,664,839 A | | 5/1987 | Rieck | 252/175 |
| 4,746,456 A | | 5/1988 | Kud et al. | 510/309 |
| 4,814,101 A | | 3/1989 | Schieferstein et al. | 424/70.2 |
| 4,985,553 A | | 1/1991 | Fuertes et al. | 536/124 |
| 5,075,041 A | | 12/1991 | Lutz | 510/537 |
| 5,356,607 A | | 10/1994 | Just | 423/334 |
| 5,501,814 A | | 3/1996 | Engelskirchen et al. | 510/471 |
| 5,541,316 A | | 7/1996 | Engelskirchen et al. | 510/471 |
| 5,780,420 A | | 7/1998 | Breuer et al. | 510/466 |
| 5,821,360 A | | 10/1998 | Engelskirchen et al. | 536/124 |
| 5,959,101 A | | 9/1999 | Engelskirchen et al. | 536/124 |
| 6,187,055 B1 | | 2/2001 | Kottwitz et al. | 8/137 |
| 6,340,664 B1 | * | 1/2002 | Gassenmeier et al. | 510/441 |
| 6,498,135 B1 | * | 12/2002 | Angell et al. | 510/441 |
| 6,506,720 B1 | | 1/2003 | Blasey et al. | 510/446 |

FOREIGN PATENT DOCUMENTS

| | | |
|---|---|---|
| CA | 2 053 900 | 10/1990 |
| CA | 2 066 226 | 3/1991 |
| CA | 2 307 429 | 3/2000 |
| DE | 2 150 557 | 6/1972 |
| DE | 28 17 369 A1 | 10/1978 |
| DE | 37 08 451 A1 | 10/1988 |
| DE | 39 29 973 A1 | 3/1991 |
| DE | 43 03 320 A1 | 8/1994 |
| DE | 44 00 024 A1 | 7/1995 |

(List continued on next page.)

OTHER PUBLICATIONS

CTFA International Cosmetic Ingredient Dictionary and Handbook, 5th Edition, The Cosmetic, Toiletry and Fragrance Association, Washington, 1993.

Falbe, et al., "Römpp Chemie Lexikon," 9th Edition, vol. 6, p. 4440, Verlag Stuttgart, New York, (1992).

Voigt, "Lehrbuch der pharmazeutischen Technologie," 6th Edition, pp. 182–184 (1987).

*Primary Examiner*—Lorna M. Douyon
(74) *Attorney, Agent, or Firm*—Stephen D. Harper; Glenn E. J. Murphy

(57) ABSTRACT

A process for coating laundry detergent or cleaning product tablets that contain builder(s) and also, if desired, further laundry detergent and cleaning product ingredients, by transporting the tablets on a conveyor belt provided with a multiplicity of apertures and forcing coating material through the conveyor belt apertures from below with a force such that the coating material forced over the conveying plane forms a surge through which the tablets are transported.

22 Claims, 1 Drawing Sheet

FOREIGN PATENT DOCUMENTS

| | | | |
|---|---|---|---|
| DE | 44 17 734 | A1 | 11/1995 |
| DE | 195 40 086 | A1 | 4/1997 |
| DE | 196 00 018 | A1 | 7/1997 |
| DE | 197 09 991 | A1 | 9/1998 |
| DE | 197 10 254 | A1 | 9/1998 |
| EP | 0 055 100 | B1 | 10/1984 |
| EP | 0 164 514 | A1 | 12/1985 |
| EP | 0 232 202 | A2 | 8/1987 |
| EP | 0 219 048 | B1 | 5/1990 |
| EP | 0 427 349 | A2 | 5/1991 |
| EP | 0 472 042 | A1 | 2/1992 |
| EP | 0 542 496 | A1 | 5/1993 |
| EP | 0 716 144 | A2 | 6/1996 |
| EP | 0 846 754 | A1 | 6/1998 |
| EP | 0 846 755 | A1 | 6/1998 |
| EP | 0 846 756 | A1 | 6/1998 |
| GB | 1 368 495 | | 9/1974 |
| JP | 58-217598 | | 12/1983 |
| WO | WO 90/13533 | A1 | 11/1990 |
| WO | WO 91/08171 | A1 | 6/1991 |
| WO | WO 92/18542 | A1 | 10/1992 |
| WO | WO 93/08251 | A1 | 4/1993 |
| WO | WO 93/16110 | A1 | 8/1993 |
| WO | WO 94/28030 | A1 | 12/1994 |
| WO | WO 95/07303 | A1 | 3/1995 |
| WO | WO 95/07331 | A1 | 3/1995 |
| WO | WO 95/12619 | A1 | 5/1995 |
| WO | WO 95/18215 | A1 | 7/1995 |
| WO | WO 95/20029 | A1 | 7/1995 |
| WO | WO 95/20608 | A1 | 8/1995 |
| WO | WO 98/40463 | A1 | 9/1998 |
| WO | WO 99/51715 | A1 * | 10/1999 |
| WO | WO 00/66701 | A1 | 11/2000 |

* cited by examiner

PROCESS FOR COATING DETERGENT TABLETS

CROSS-REFERENCE TO RELATED APPLICATIONS

This application is a continuation application of International Application PCT/EP01/14783, claiming priority under 35 U.S.C. §365(c) of International Application PCT/EP01/14783, filed Dec. 14, 2001 in the European Patent Office, and claiming foreign priority under 35 U.S.C. §119 of DE 100 64 985.8, filed Dec. 23, 2000, in the German Patent Office.

BACKGROUND OF THE INVENTION

The present invention relates to a process for coating laundry detergent or cleaning product tablets, which contain builder(s) and also, where appropriate, other laundry detergent and cleaning product ingredients.

Laundry detergent and cleaning product tablets have been widely described in the prior art and are enjoying increasing popularity among users owing to the ease of dosing. Tableted laundry detergents and cleaning products have a number of advantages over their powder-form counterparts: they are easier to dose and to handle, and have storage and transport advantages owing to their compact structure. Consequently, laundry detergent and cleaning product tablets have been described comprehensively in the patent literature as well. One problem which occurs again and again in connection with the use of detersive tablets is the inadequate disintegration and dissolution rate of the tablets under application conditions. Since tablets of sufficient stability, i.e., dimensional stability and fracture resistance, can be produced only by means of relatively high compressive pressures, there is severe compaction of the tablet constituents and, consequently, retarded disintegration of the tablet in the aqueous liquor, leading to excessively slow release of the active substances in the washing or cleaning operation. The retarded disintegration of the tablets also has the drawback that customary laundry detergent and cleaning product tablets cannot be rinsed in via the rinse-in compartment of household washing machines, since the tablets do not breakdown with sufficient rapidity into secondary particules small enough to be rinsed into the wash drum from said compartment. Another problem which occurs in particular with laundry detergent and cleaning product tablets is the friability of the tablets, or their often inadequate stability to abrasion. Thus, although it is possible to produce sufficiently fracture-stable, i.e., hard laundry detergent and cleaning product tablets, these tablets are often not up to the loads involved in packaging, transit and handling, i.e., falling stresses and frictional stresses, with the result that edge-fracture and abrasion phenomena may impair the appearance of the tablet or may even lead to complete destruction of the tablet structure.

To overcome the dichotomy between hardness, i.e., transport and handling stability, and the ready disintegration of the tablets, numerous approaches to solutions have been developed in the prior art. One approach, which is known in particular from the field of pharmacy and has expanded into the field of laundry detergent and cleaning product tablets, is the incorporation of certain disintegration aids, which facilitate the ingress of water or which, on ingress of water, swell, evolve gas, or exert a disintegrating effect in another form. Other proposed solutions from the patent literature describe the compression of premixes of defined particle sizes, the separation of certain ingredients from certain other ingredients, and the coating of individual ingredients, or of the whole tablet, with binders.

The coating of laundry detergent and cleaning product tablets is subject-matter of a number of patent applications.

For instance, European Patent Applications EP 846 754, EP 846 755 and EP 846 756 (Procter & Gamble) describe coated laundry detergent tablets comprising a "core" comprising compacted particulate laundry detergent and cleaning product, and a "coating", the coating materials used comprising dicarboxylic acids, especially adipic acid, which if desired comprise further ingredients, examples being disintegration aids.

Coated laundry detergent tablets are also subject-matter of European Patent Application EP 716 144 (Unilever). According to the details in that document, the hardness of the tablets may be intensified by means of a "coating" without detracting from the disintegration and dissolution times. Coating agents specified are film-forming substances, especially copolymers of acrylic acid and maleic acid, or sugars.

The coating of the tablets is advantageous for the strength, the reduction of abrasion and dust, edge stability, storage stability, visual impression, and the sensory quality on handling by the user. The coating ought to envelop the laundry detergent and cleaning product tablet. In order to do so, the coating material, which is used in the form alternatively of a melt, solution or dispersion, must be applied with the maximum of uniformity and targetedness.

The processes known from the prior art have the drawback that the application of the coating by means of spraying or dipping methods imposes particular requirements on the properties of the coating material, in particular on its viscosity.

The object on which the present invention was based was to provide a process for coating laundry detergent and cleaning product tablets which allows both the top and bottom faces and also the sides to be coated, and in the case of which it ought also to be possible to apply partial coatings. Owing to the tablets' inherent sensitivity to mechanical loads, a further object was to provide a process for coating such tablets in which the tablets are exposed only to a very low mechanical load.

DESCRIPTION OF THE INVENTION

Figure 1:
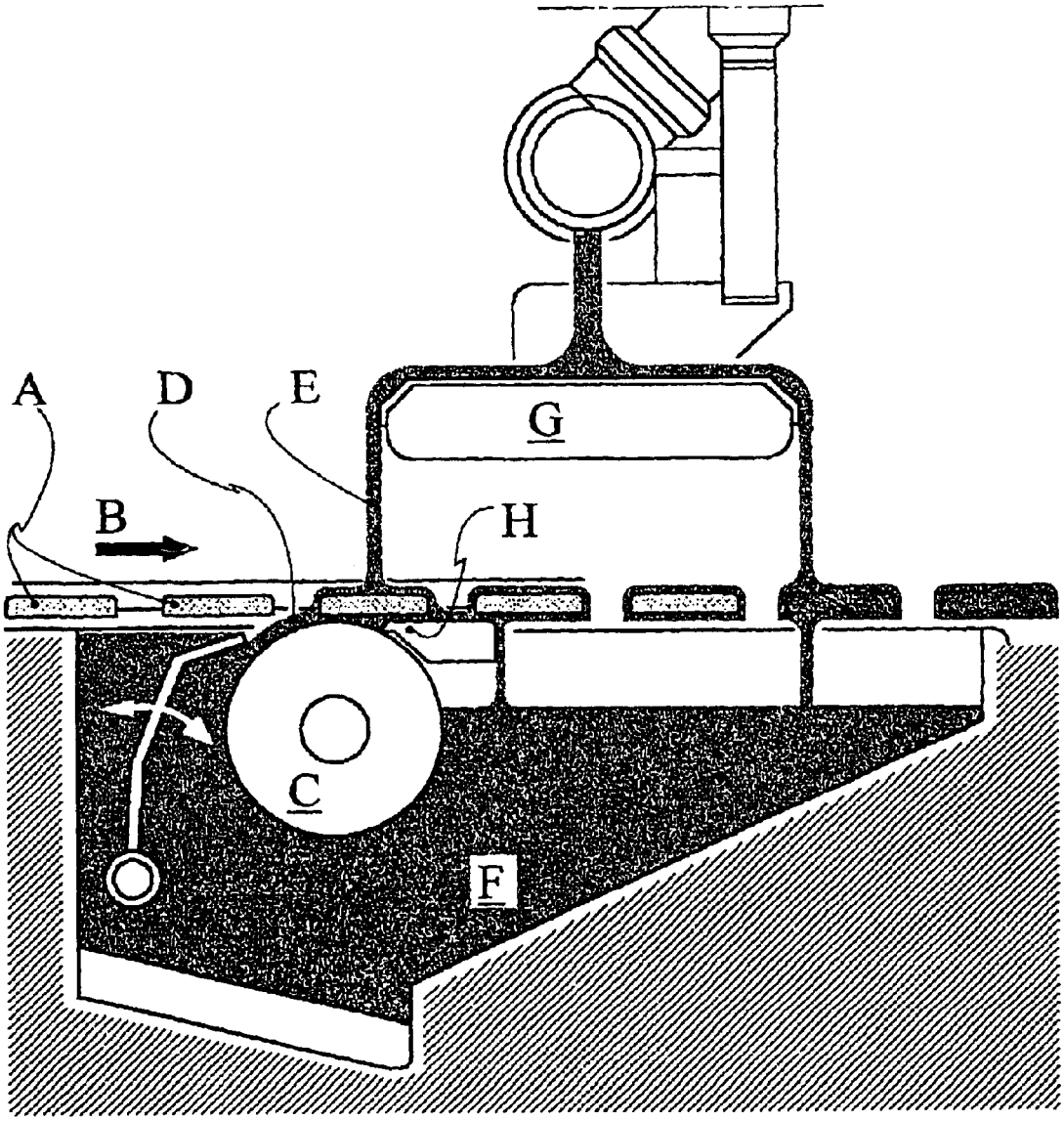
FIG. 1 is a coating process according to the invention.

The present invention accordingly provides a process for coating laundry detergent or cleaning product tablets, comprising builder(s) and, if desired, further laundry detergent and cleaning product ingredients, which is characterized in that the tablets are transported on a conveyor belt which is provided with a multiplicity of apertures and coating material is forced from below through the conveyor belt with a force such that above the conveying plane the material forms a surge through which the tablets are transported.

The process of the invention has the advantage that the requirements on the physical properties of the coating materials to be applied are less restrictive than in the case of the processes described in the prior art, in which solutions or melts are applied by spraying. Indeed, the viscosity of the applied coating material can be varied over a wide range. Furthermore, with the process of the invention, the coat thickness can be adjusted with precision, which in contrast to the conventional processes, such as the dipping processes, does not take place. Moreover, it is possible to apply the coating to the recumbent face of the tablet on the conveyor belt.

With the process of the invention it is possible to elect to coat only the recumbent face of the tablets on the conveyor belt, the recumbent face and the side face, at least in part, or the tablet in its entirety, i.e., all the faces. By adjusting the height of the surge it is possible to determine whether only the recumbent face of the tablet and, where appropriate, the side faces as well, at least partly, are coated. If the height of the surge is low, only the recumbent face is coated; the higher the surge, the greater the parts of the side faces which can also be coated.

In one preferred embodiment of the present invention the tablets additionally pass through a mist of coating material, so that the faces opposite the recumbent face and also, where appropriate, the upper parts of the side faces are coated as well.

Particularly gentle and complete coating of the recumbent face of the tablets can be achieved if the extent of the surge is set such that the tablets lift from the conveyor belt under the pressure of the surge, i.e., the recumbent face of the tablets comes away from the conveyor belt.

The surge of the coating material which is forced from below through the apertures in the conveyor belt can be generated by means of devices that are known to the skilled worker. In one preferred embodiment of the present invention the surge is generated by means of a roller which rotates in the coating material, the movement of the surge being produced in the direction of the conveying direction of the tablets. In another embodiment the surge can alternatively be produced by way of means which bring about pressure/counterpressure. With particular preference the speed of the surge on emergence from the apertures is approximately equal to the speed of the conveyor belt. This embodiment has the advantage that the tablets to be coated hardly change their position on the conveyor belt and their distance from one another, thereby allowing mechanical loads as a result of changes in position to be minimized.

Excess coating material can be returned to the storage vessel envisaged for the purpose. The return flow of material can be regulated by way of appropriate means. Where the surge is generated by a rotating roller, the return flow of the coating material can be adjusted, for example, by way of a slide valve which is adjustable tangentially in the direction of the roller.

The thickness of the coating can also be regulated following application as well, for example, by transporting the tablets over suitable leak shafts or by blowing the coating before it has fully cured.

As already stated, the viscosity of the coating material can be varied over a wide range. The coating material is applied preferably in the form of a solution or dispersion or in the form of a melt. It is preferably selected from polymers or polymer mixtures, in particular from preferably water-soluble and/or meltable polymers or polymer mixtures. By targeted selection of polymers and/or polymer mixtures it is possible to adjust the properties of the coating.

The polymers or polymer mixtures are preferably selected from a) water-soluble nonionic polymers from the group of
- a1) polyvinylpyrrolidones
- a2) vinylpyrrolidone-vinyl ester copolymers
- a3) cellulose ethers
- a4) homopolymers of vinyl alcohol, copolymers of vinyl alcohol with copolymerizable monomers, or hydrolysis products of vinyl ester homopolymers or vinyl ester copolymers with copolymerizable monomers b) water-soluble amphoteric polymers from the group of
- b1) alkylacrylamide-acrylic acid copolymers
- b2) alkylacrylamide-methacrylic acid copolymers
- b3) alkylacrylamide-methylmethacrylic acid copolymers
- b4) alkylacrylamide-acrylic acid-alkylaminoalkyl-(meth) acrylic acid copolymers
- b5) alkylacrylamide-methacrylic acid-alkylamino-alkyl (meth)acrylic acid copolymers
- b6) alkylacrylamide-methylmethacrylic acid-alkyl-aminoalkyl(meth)acrylic acid copolymers
- b7) alkylacrylamide-alkyl methacrylate-alkylamino-ethyl methacrylate-alkyl methacrylate copolymers
- b8) copolymers of
  - b8i) unsaturated carboxylic acids
  - b8ii) cationically derivatized unsaturated carboxylic acids
  - b8iii) if desired, further ionic or nonionic monomers c) water-soluble zwitterionic polymers from the group of
- c1) acrylamidoalkyltrialkylammonium chloride-acrylic acid copolymers and their alkali metal and ammonium salts
- c2) acrylamidoalkyltrialkylammonium chloride-methacrylic acid copolymers and their alkali metal and ammonium salts
- c3) methacroylethyl betaine-methacrylate copolymers d) water-soluble anionic polymers from the group of
- d1) vinyl acetate-crotonic acid copolymers
- d2) vinylpyrrolidone-vinyl acrylate copolymers
- d3) acrylic acid-ethyl acrylate-N-tert-butylacryl-amide terpolymers
- d4) graft polymers of vinyl esters, esters of acrylic acid or methacrylic acid alone or in a mixture, copolymerized with crotonic acid, acrylic acid or methacrylic acid with poly-alkylene oxides and/or polyalkylene glycols
- d5) grafted and crosslinked copolymers from the copolymerization of
  - d5i) at least one monomer of the nonionic type,
  - d5ii) at least one monomer of the ionic type,
  - d5iii) polyethylene glycol, and
  - d5iv) a crosslinker
- d6) copolymers obtained by copolymerizing at least one monomer from each of the three following groups:
  - d6i) esters of unsaturated alcohols and short-chain saturated carboxylic acids and/or esters of short-chain saturated alcohols and unsaturated carboxylic acids,
  - d6ii) unsaturated carboxylic acids,
  - d6iii) esters of long-chain carboxylic acids and unsaturated alcohols and/or esters of the carboxylic acids of group d6ii) with saturated or unsaturated, straight-chain or branched $C_{8-18}$ alcohol
- d7) graft copolymers obtainable by grafting d7i) polyalkylene oxides with d7ii) vinyl acetate
- d8) terpolymers of crotonic acid, vinyl acetate and an allyl or methallyl ester
- d9) tetra- and pentapolymers of
  - d9i) crotonic acid or allyloxyacetic acid
  - d9ii) vinyl acetate or vinyl propionate
  - d9iii) branched allyl or methallyl esters
  - d9iv) vinyl ethers, vinyl esters or straight-chain allyl or methallyl esters d10) crotonic acid copolymers with one or more monomers from the group consisting of ethylene, vinylbenzene, vinyl methyl ether, acrylamide and water-soluble salts thereof d11) terpolymers of vinyl acetate, crotonic acid and vinyl esters of a saturated aliphatic α-branched monocarboxylic acid e) water-soluble cationic polymers from the group of e1) quaternized cellulose derivatives e2) polysiloxanes with quaternary groups e3) cationic guar derivatives e4) polymeric dimethyldiallylammonium salts and their copolymers with esters and amides of acrylic acid and methacrylic acid e5) copolymers of vinylpyrrolidone with quaternized derivatives of dialkylaminoacrylate and -methacrylate e6) vinylpyrrolidone-methoimidazolinium chloride copolymers e7) quaternized polyvinyl alcohol e8) polymers indicated under the INCI designations Polyquaternium 2, Polyquaternium 17, Polyquaternium 18, and Polyquaternium 27 f) polyurethanes g) LCST polymers, preferably selected from alkylated and/or hydroxyalkylated polysaccharides, cellulose ethers, acrylamides, such as polyisopropylacrylamide, copolymers of acrylamides, polyvinylcaprolactam, copolymers of polyvinylcaprolactam, particularly those with polyvinylpyrrolidone, polyvinyl methyl ether, copolymers of polyvinyl methyl ether, and blends of these substances.

Water-soluble polymers in the sense of the invention are those polymers which are soluble to the extent of more than 2.5% by weight at room temperature in water.

Water-soluble polymers which are preferred in accordance with the invention are nonionic. Examples of suitable nonionic polymers are the following:

Polyvinylpyrrolidones, as marketed, for example, under the designation Luviskol® (BASF). Polyvinylpyrrolidones are preferred nonionic polymers in the context of the invention.

Polyvinylpyrrolidones [poly(1-vinyl-2-pyrrolidinones)], abbreviated PVP, are polymers of the general formula (I)

(I)

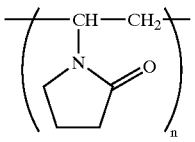

prepared by free-radical addition polymerization of 1-vinylpyrrolidone by processes of solution or suspension polymerization using free-radical initiators (peroxides, azo compounds). The ionic polymerization of the monomer yields only products having low molecular masses. Commercially customary polyvinylpyrrolidones have molecular masses in the range from approx. 2500–750,000 g/mol, which are characterized by stating the K values and—depending on the K value—have glass transition temperatures of 130–175°. They are supplied as white, hygroscopic powders or as aqueous solutions.

Polyvinylpyrrolidones are readily soluble in water and a large number of organic solvents (alcohols, ketones, glacial acetic acid, chlorinated hydrocarbons, phenols, etc).

Vinylpyrrolidone-vinyl ester copolymers, as marketed for example under the trademark Luviskol® (BASF). Luviskol® VA 64 and Luviskol® VA 73, each vinylpyrrolidone-vinyl acetate copolymers, are particularly preferred nonionic polymers. The vinyl ester polymers are polymers obtainable from vinyl esters and featuring the grouping of the formula (II)

(II)

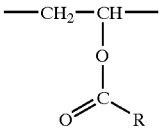

as the characteristic basic structural unit of the macromolecules. Of. these, the vinyl acetate polymers ($R{=}CH_3$) with polyvinyl acetates, as by far the most important representatives, have the greatest industrial significance.

The vinyl esters are polymerized free-radically by various processes (solution polymerization, suspension polymerization, emulsion polymerization, and bulk polymerization). Copolymers of vinyl acetate with vinylpyrrolidone comprise monomer units of the formulae (I) and (II)

Cellulose ethers, such as hydroxypropylcellulose, hydroxyethylcellulose and methylhydroxypropylcellulose, as marketed for example under the trademarks Culminal® and Benecel® (AQUALON). Cellulose ethers may be described by the general formula (III)

(III)

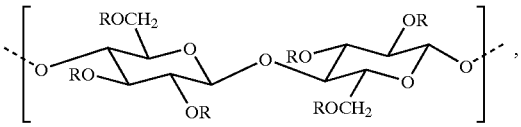

where R is H or an alkyl, alkenyl, alkynyl, aryl, or alkylaryl radical. In preferred products, at least one R in formula (III) is $—CH_2CH_2CH_2—OH$ or $—CH_2CH_2—OH$. Cellulose ethers are prepared industrially by etherifying alkali metal cellulose (e.g., with ethylene oxide). Cellulose ethers are characterized by way of the average degree of substitution, DS, and/or by the molar degree of substitution, MS, which indicate how many hydroxyl groups of an anhydroglucose unit of cellulose have reacted with the etherifying reagent or how many moles of the etherifying reagent have been added on, on average, to one anhydroglucose unit. Hydroxyethylcelluloses are water-soluble above a DS of approximately 0.6 and, respectively, an MS of approximately 1. Commercially customary hydroxyethyl- and hydroxypropylcelluloses have degrees of substitution in the range of 0.85–1.35 (DS) and 1.5–3 (MS), respectively. Hydroxyethyl- and -propylcelluloses are marketed as yellowish white, odorless and tasteless powders in greatly varying degrees of polymerization. Hydroxyethyl- and -propylcelluloses are soluble in cold and hot water and in some (water-containing) organic solvents, but insoluble in the majority of (anhydrous) organic solvents; their aqueous solutions are relatively insensitive to changes in pH or addition of electrolyte.

Homopolymers of vinyl alcohol, copolymers of vinyl alcohol with copolymerizable monomers, or hydrolysis products of vinyl ester homopolymers or vinyl ester copolymers with copolymerizable monomers can likewise be employed.

Homopolymers or copolymers of vinyl alcohol cannot be obtained by polymerizing vinyl alcohol ($H_2C{=}CH{-}OH$), since its concentration in the tautomeric equilibrium with acetaldehyde ($H_3C{-}CHO$) is too low. These polymers are therefore prepared principally from polyvinyl esters, especially polyvinyl acetates, by way of polymer-analogous reactions such as hydrolysis, or particularly, in industry, by alkali-catalyzed transesterification with alcohols (preferably methanol) in solution.

Where the corresponding vinyl ester homopolymers or vinyl ester copolymers are not hydrolyzed, they are coating materials of the second-mentioned group.

"Polyvinyl alcohols" (abbreviation PVAL, occasionally also PVOH) is the designation for polymers of the general structure

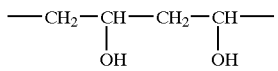

which in small proportions (about 2%) also contains structural units of the type

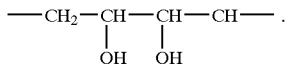

Commercial polyvinyl alcohols, which are offered as whitish yellow powders or granules with degrees of polymerization in the range from approximately 100 to 2500 (molar masses from approximately 4000 to 100 000 g/mol), have degrees of hydrolysis of 98–99 or 87–89 mol %, and thus still contain a residual amount of acetyl groups. Manufacturers characterize the polyvinyl alcohols by stating the degree of polymerization of the starting polymer, the degree of hydrolysis, the saponification number, and/or the solution viscosity.

Depending on the degree of hydrolysis polyvinyl alcohols are soluble in water and a few strongly polar organic solvents (formamide, dimethylformamide, dimethyl sulfoxide); they are not attacked by (chlorinated) hydrocarbons, esters, fats, and oils. Polyvinyl alcohols are classed as toxicologically unobjectionable and are at least partly biodegradable. The solubility in water can be reduced by aftertreatment with aldehydes (acetalization), by complexing with Ni salts or Cu salts, or by treatment with dichromates, boric acid or borax. The coatings of polyvinyl alcohol are substantially inpenetrable for gases such as oxygen, nitrogen, helium, hydrogen, and carbon dioxide, but do allow the passage of water vapor.

Preference is given to using polyvinyl alcohols of a defined molecular weight range, such as from 10 000 to 100 000 $gmol^{-1}$, preferably from 11 000 to 90 000 $gmol^{-1}$, more preferably from 12 000 to 80 000 $gmol^{-1}$, and in particular from 13 000 to 70 000 $gmol^{-1}$.

The degree of polymerization of such preferred polyvinyl alcohols lies between approximately 200 to approximately 2100, preferably between approximately 220 to approximately 1890, with particular preference between approximately 240 to approximately 1680, and in particular between approximately 260 to approximately 1500.

The polyvinyl alcohols described above are widely available commercially, for example, under the trade marks Mowiol® (Clariant). Polyvinyl alcohols particularly suitable in the context of the present invention are, for example, Mowiol® 3-88, Mowiol® 4-88, Mowiol® 5-88, and Mowiol® 8-88.

Further polymers suitable in accordance with the invention are water-soluble amphopolymers. The generic term amphopolymers embraces amphoteric polymers, i.e., polymers whose molecule includes both free amino groups and free —COOH or $SO_3H$ groups and which are capable of forming inner salts; zwitterionic polymers whose molecule includes quaternary ammonium groups and $—COO^-$ or $—SO_3^-$ groups, and polymers containing —COOH or $SO_3H$ groups and quaternary ammonium groups. An example of an amphopolymer which may be used in accordance with the invention is the acrylic resin obtainable under the designation Amphomer®, which constitutes a copolymer of tert-butylaminoethyl methacrylate, N-(1,1,3,3-tetramethylbutyl)acrylamide, and two or more monomers from the group consisting of acrylic acid, methacrylic acid and their simple esters. Likewise preferred amphopolymers are composed of unsaturated carboxylic acids (e.g., acrylic and methacrylic acid), cationically derivatized unsaturated carboxylic acids, (e.g., acrylamidopropyltrimethylammonium chloride), and, if desired, further ionic or nonionic monomers, as evident, for example, from German Laid-Open Specification 39 29 973 and the prior art cited therein. Terpolymers of acrylic acid, methyl acrylate and methacrylamidopropyltrimonium chloride, as obtainable commercially under the designation Merquat® 2001 N, are particularly preferred amphopolymers in accordance with the invention. Further suitable amphoteric polymers are, for example, the octylacrylamide-methyl methacrylate-tert-butylaminoethyl methacrylate-2-hydroxypropyl methacrylate copolymers available under the designations Amphomer® and Amphomer® LV-71 (DELFT NATIONAL).

Examples of suitable zwitterionic polymers are the addition polymers disclosed in German Patent Applications DE 39 29 973, DE 21 50 557, DE 28 17 369 and DE 37 08 451. Acrylamidopropyltrimethylammonium chloride-acrylic acid or -methacrylic acid copolymers and their alkali metal salts and ammonium salts are preferred zwitterionic polymers. Further suitable zwitterionic polymers are methacryloylethyl betaine-methacrylate copolymers, which are obtainable commercially under the designation Amersette® (AMERCHOL).

Anionic polymers that are suitable in accordance with the invention include:

Vinyl acetate-crotonic acid copolymers, as commercialized, for example, under the designations Resyn® (NATIONAL STARCH), Luviset® (BASF) and Gafset® (GAF). In addition to monomer units of the above formula (II), these polymers also have monomer units of the general formula (IV):

$$[{-}CH(CH_3){-}CH(COOH){-}]_n \qquad (IV)$$

Vinylpyrrolidone-vinyl acrylate copolymers, obtainable for example under the trademark Luviflex® (BASF). A preferred polymer is the vinyl-pyrrolidone-acrylate terpolymer obtainable under the designation Luviflex VBM-35 (BASF).

Acrylic acid-ethyl acrylate-N-tert-butylacrylamide terpolymers, which are marketed for example under the designation Ultrahold® strong (BASF).

Graft polymers of vinyl esters, esters of acrylic acid or methacrylic acid alone or in a mixture, copolymerized with crotonic acid, acrylic acid or methacrylic acid with polyalkylene oxides and/or polyalkylene glycols.

Such grafted polymers of vinyl esters, esters of acrylic acid or methacrylic acid alone or in a mixture with other copolymerizable compounds onto polyalkylene glycols are obtained by polymerization under hot conditions in homogeneous phase, by stirring the polyalkylene glycols into the monomers of the vinyl esters, esters of acrylic acid or methacrylic acid, in the presence of free-radical initiators.

Vinyl esters which have been found suitable are, for example, vinyl acetate, vinyl propionate, vinyl butyrate, vinyl benzoate, and esters of acrylic acid or methacrylic acid which have been found suitable are those obtainable with low molecular weight aliphatic alcohols, i.e., in particular, ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol, 3-methyl-2-butanol, 2-methyl-2-butanol, 2-methyl-1-butanol, and 1-hexanol.

Suitable polyalkylene glycols include in particular polyethylene glycols and polypropylene glycols. Polymers of ethylene glycol which satisfy the general formula V $$H—(O—CH_2—CH_2)_n—OH \quad (V)$$

in which n may adopt values between 1 (ethylene glycol) and several thousand. For polyethylene glycols there exist various nomenclatures, which may lead to confusion. It is common in the art to state the average relative molar weight after the letters "PEG", so that "PEG 200" characterizes a polyethylene glycol having a relative molar mass of about 190 to about 210. For cosmetic ingredients, a different nomenclature is used, in which the abbreviation PEG is provided with a hyphen and the hyphen is followed directly by a number which corresponds to the number n in the abovementioned formula V. According to this nomenclature (known as the INCI nomenclature, CTFA International Cosmetic Ingredient Dictionary and Handbook, 5th Edition, The Cosmetic, Toiletry and Fragrance Association, Washington, 1997), for example, PEG-4, PEG-6, PEG-8, PEG-9, PEG-10, PEG-12, PEG-14 and PEG-16 may be used. Polyethylene glycols are available commercially, for example, under the trade names Carbowax® PEG 200 (Union Carbide), Emkapol® 200 (ICI Americas), Lipoxol® 200 MED (HÜLS America), Polyglycol® E-200 (Dow Chemical), Alkapol® PEG 300 (Rhone-Poulenc), Lutrol® E300 (BASF), and the corresponding trade names with higher numbers.

Polypropylene glycols (abbreviation PPGs) are polymers of propylene glycol which satisfy the general formula VI $$H—(O—\underset{\underset{CH_3}{|}}{CH}—CH_2)_n—OH \quad (VI)$$

in which n may adopt values between 1 (propylene glycol) and several thousand. Of industrial significance here are in particular di-, tri-, and tetrapropylene glycol, i.e., the representatives where n=2, 3 and 4 in formula VI.

In particular, it is possible to use the vinyl acetate copolymers grafted onto polyethylene glycols and the polymers of vinyl acetate and crotonic acid grafted onto polyethylene glycols.

Grafted and crosslinked copolymers from the copolymerization of i) at least one monomer of the nonionic type, ii) at least one monomer of the ionic type, iii) polyethylene glycol, and iv) a crosslinker The polyethylene glycol used has a molecular weight of between 200 and several million, preferably between 300 and 30,000.

The nonionic monomers may be of very different types and include the following preferred monomers: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether, and 1-hexene.

The nonionic monomers may equally be of very different types, among which particular preference is given to the presence in the graft polymers of crotonic acid, allyloxyacetic acid, vinylacetic acid, maleic acid, acrylic acid, and methacrylic acid.

Preferred crosslinkers are ethylene glycol dimethacrylate, diallyl phthalate, ortho-, meta- and para-divinylbenzene, tetraallyloxyethane, and polyallylsaccharoses containing 2 to 5 allyl groups per molecule of saccharin.

The above-described grafted and crosslinked copolymers are formed preferably of:

i) from 5 to 85% by weight of at least one monomer of the nonionic type, ii) from 3 to 80% by weight of at least one monomer of the ionic type, iii) from 2 to 50% by weight, preferably from 5 to 30% by weight, of polyethylene glycol, and iv) from 0.1 to 8% by weight of a crosslinker, the percentage of the crosslinker depending on the ratio of the overall weights of i), ii) and iii).

Copolymers obtained by copolymerizing at least one monomer from each of the three following groups:

i) esters of unsaturated alcohols and short-chain saturated carboxylic acids and/or esters of short-chain saturated alcohols and unsaturated carboxylic acids, ii) unsaturated carboxylic acids, iii) esters of long-chain carboxylic acids and unsaturated alcohols and/or esters of the carboxylic acids of group ii) with saturated or unsaturated, straight-chain or branched $C_{8-18}$ alcohol Short-chain carboxylic acids and alcohols here are those having 1 to 8 carbon atoms, it being possible for the carbon chains of these compounds to be interrupted, if desired, by divalent hetero-groups such as —O—, —NH—, and —S—.

Graft copolymers of polyalkylene oxide on vinyl acetate are described in European patent application EP 219 048 A (BASF). They are obtainable by grafting a polyalkylene oxide with vinyl acetate, it being possible for some of the acetate groups of the vinyl acetate to have been hydrolyzed. Particularly suitable polyalkylene oxides include polymers with ethylene oxide, propylene oxide, and butylene oxide units, with polyethylene oxide being preferred.

The graft copolymers are prepared, for example, by dissolving the polyalkylene oxides in vinyl acetate and by continuous or batchwise polymerization following addition of a polymerization initiator, or by semicontinuous polymerization, in which a portion of the polymerization mixture comprising polyalkylene oxide, vinyl acetate, and polymerization initiator is heated to polymerization temperature and then the remainder of the mixture to be polymerized is added. The graft copolymers can also be obtained by introducing polyalkylene oxide as the initial charge, heating it to the polymerization temperature, and adding vinyl acetate and polymerization initiator alternatively all at once, in portions or, preferably, continuously.

Where the graft copolymers described above are employed, the coating contains at least 50% by weight of graft copolymers obtainable by grafting (a) polyalkylene oxides of a molecular weight of from 1500 to 70 000 $gmol^{-1}$ with (b) vinyl acetate in an (a):(b) weight ratio of from 100:1 to 1:5, the acetate groups having been hydrolyzed if desired to an extent of up to 15%.

In preferred embodiments of the present invention the molecular weight of the polyalkylene oxides present in the graft copolymers is from 2 000 to 50 000 $gmol^{-1}$, preferably from 2500 to 40 000 $gmol^{-1}$, with particular preference from 3 000 to 20 000 $gmol^{-1}$, and in particular from 4 000 to 10 000 $gmol^{-1}$.

The fraction of the individual monomers can be varied as a function of the desired properties of the coating. Preferred coatings are those in which the vinyl acetate fraction in the graft copolymers is from 1 to 60% by weight, preferably from 2 to 50% by weight, with particular preference from 3 to 40% by weight, and in particular from 5 to 25% by weight, based in each case on the graft copolymer.

A graft copolymer which is particularly preferred in the context of the present invention is based on a polyethylene oxide having an average molar mass of 6 000 gmol-1 (corresponding to 136 ethylene oxide units) and containing about 3 parts by weight of vinyl acetate per part by weight of polyethylene oxide. This polymer, which possesses an average molar mass of approximately 24 000 gmol-1, is sold commercially by BASF under the name Sokalan(r) HP22.

Terpolymers of crotonic acid, vinyl acetate, and an allyl or methallyl ester.

These terpolymers contain monomer units of the general formulae (II) and (IV) (see above) and also monomer units of one or more allyl or methallyl esters of the formula VII:

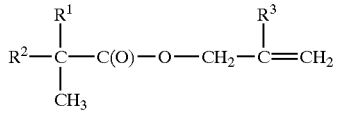

(VII)

in which $R^3$ is —H or —$CH_3$, $R^2$ is —$CH_3$ or —$CH(CH_3)_2$ and $R^1$ is —$CH_3$ or a saturated straight-chain or branched $C_{1-6}$ alkyl radical and the sum of the carbon atoms in the radicals $R^1$ and $R^2$ is preferably 7, 6, 5, 4, 3 or 2.

The abovementioned terpolymers result preferably from the copolymerization of from 7 to 12% by weight of crotonic acid, from 65 to 86% by weight, preferably from 71 to 83% by weight, of vinyl acetate and from 8 to 20% by weight, preferably from 10 to 17% by weight, of allyl or methallyl esters of the formula VII.

Tetra- and pentapolymers of i) crotonic acid or allyloxyacetic acid ii) vinyl acetate or vinyl propionate iii) branched allyl or methallyl esters iv) vinyl ethers, vinyl esters or straight-chain allyl or methallyl esters Crotonic acid copolymers with one or more monomers from the group consisting of ethylene, vinylbenzene, vinyl methyl ether, acrylamide and the water-soluble salts thereof Terpolymers of vinyl acetate, crotonic acid and vinyl esters of a saturated aliphatic a-branched monocarboxylic acid.

Further polymers which may be used with preference as coating constituents are cationic polymers. Among the cationic polymers, the permanently cationic polymers are preferred. "Permanently cationic" refers according to the invention to those polymers which independently of the pH of the composition (i.e., both of the coating and of the tablet) have a cationic group. These are generally polymers which include a quaternary nitrogen atom, in the form of an ammonium group, for example.

Examples of preferred cationic polymers are the following:

Quaternized cellulose derivatives, as available commercially under the designations Celquat® and Polymer JR®. The compounds Celquat® H 100, Celquat® L 200 and Polymer JR® 400 are preferred quaternized cellulose derivatives.

Polysiloxanes with quaternary groups, such as, for example, the commercially available products Q2-7224 (manufacturer: Dow Corning; a stabilized trimethylsilylamodimethicone), Dow Corning® 929 emulsion (comprising a hydroxyl-amino-modified silicone, also referred to as amodimethicone), SM-2059 (manufacturer: General Electric), SLM-55067 (manufacturer: Wacker), and Abil®-Quat 3270 and 3272 (manufacturer: Th. Goldschmidt; diquaternary polydimethylsiloxanes, Quaternium-80), Cationic guar derivatives, such as in particular the products marketed under the trade names Cosmedia® Guar and Jaguar®, Polymeric dimethyldiallylammonium salts and their copolymers with esters and amides of acrylic acid and methacrylic acid. The products available commercially under the designations Merquat® 100 (poly (dimethyldiallylammonium chloride)) and Merquat® 550 (dimethyldiallylammonium chloride-acrylamide copolymer) are examples of such cationic polymers.

Copolymers of vinylpyrrolidone with quaternized derivatives of dialkylamino acrylate and methacrylate, such as, for example, diethyl sulfate-quaternized vinylpyrrolidone-dimethylamino methacrylate copolymers. Such compounds are available commercially under the designations Gafquat® 734 and Gafquat® 755.

Vinylpyrrolidone-methoimidazolinium chloride copolymers, as offered under the designation Luviquat®.

Quaternized polyvinyl alcohol and also polymers known under the designations

Polyquaternium 2

Polyquaternium 17,

Polyquaternium 18, and

Polyquaternium 27, having quaternary nitrogen atoms in the polymer main chain. These polymers are designated in accordance with the INCI nomenclature; detailed information can be found in the CTFA International Cosmetic Ingredient Dictionary and Handbook, 5th Edition, The Cosmetic, Toiletry and Fragrance Association, Washington, 1997, which is expressly incorporated herein by reference.

Cationic polymers which are preferred in accordance with the invention are quaternized cellulose derivatives and also polymeric dimethyldiallylammonium salts and copolymers thereof. Cationic cellulose derivatives, especially the commercial product Polymer® JR 400, are especially preferred cationic polymers.

Further suitable coating material are polyurethanes, which are normally synthesized from diisocyanates (VIII) and diols (IX).

$$O{=}C{=}N{-}R^4{-}N{=}C{=}O \quad \text{(VIII)},$$

$$H{-}O{-}R^5{-}O{-}H \quad \text{(IX)},$$

where the diols are selected at least proportionally from polyethylene glycols (IXa) and/or polypropylene glycols (IXb)

$$H{-}(O{-}CH_2{-}CH_2)_n{-}OH \quad \text{(IXa)},$$

$$H{-}(O{-}\underset{\underset{CH_3}{|}}{CH}{-}CH_2)_n{-}OH, \quad \text{(IXb)}$$

and $R^4$ and $R^5$ independently of one another are each a substituted or unsubstituted, straight-chain or branched alkyl, aryl or alkylaryl radical having 1 to 24 carbon atoms, and each n stands for numbers from 5 to 2000.

As coating materials it is also possible to use polyurethanes.

Polyurethanes are polyadducts of at least two different types of monomer, a di- or polyisocyanate (A) and a compound (B) having at least 2 active hydrogen atoms per molecule.

The polyurethanes which can be used in the coating are obtained from reaction mixtures which comprise at least one diisocyanate of the formula (VIII) and at least one polyethylene glycol of the formula (IXa) and/or at least one polypropylene glycol of the formula (IXb).

In addition the reaction mixtures may comprise further polyisocyanates. Also possible is the presence in the reaction mixtures—and hence in the polyurethanes—of other diols, triols, diamines, triamines, polyetherols, and polyesterols. The compounds having more than 2 active hydrogen atoms are normally used in small amounts in combination with a large excess of compounds having 2 active hydrogen atoms.

Where further diols, etc., are added it is necessary to observe particular proportions in relation to the polyethylene and/or polypropylene glycol units that may be present in the polyurethane. Preference is given here to laundry detergent or cleaning product tablets in which at least 10% by weight, preferably at least 25% by weight, with particular preference at least 50% by weight, and in particular at least 75% by weight of the diols incorporated into the polyurethane by reaction are selected from polyethylene glycols (IXa) and/or polypropylene glycols (IXb).

The polyurethanes contain, as monomer unit, diisocyanates of the formula (VIII). Diisocyanates used are predominantly hexamethylene diisocyanate, 2,4- and 2,6-toluene diisocyanate, 4,4'-methylenedi(phenyl isocyanate) and, in particular, isophorone diisocyanate. These compounds can be described by the formula I given above in which $R^1$ is a connecting group of carbon atoms, for example, a methylene, ethylene, propylene, butylene, pentylene, hexylene, etc., group. In the abovementioned hexamethylene diisocyanate (HMDI), which is the one generally used in industry, it is the case that $R^1{=}(CH_2)_6$; in 2,4- and 2,6-toluene diisocyanate (TDI) $R^1$ is $C_6H_3{-}CH_3$), in 4,4'-methylenedi(phenyl isocyanate) (MDI) it is $C_6H_4{-}CH_2{-}C_6H_4$), and in isophorone diisocyanate $R^1$ stands for the isophorone radical (3,5,5-trimethyl-2-cyclohexenone).

The polyurethanes which can be used in accordance with the invention as coating material contain, as a monomer unit, addition diols of the formula (IX), these diols originating at least partly from the group of the polyethylene glycols (IXa) and/or of the polypropylene glycols (IXb). Polyethylene glycols are polymers of ethylene glycol which satisfy the general formula (IXa)

$$H{-}(O{-}CH_2{-}CH_2)_n{-}OH \quad \text{(IXa)}$$

in which n may adopt values between 5 and 2000. For polyethylene glycols there exist various nomenclatures, which may lead to confusion. It is common in the art to state the average relative molar weight after the letters, "PEG", so that "PEG 200" characterizes a polyethylene glycol having a relative molar mass of about 190 to about 210. For cosmetic ingredients, a different nomenclature is used, in which the abbreviation PEG is provided with a hyphen and the hyphen is followed directly by a number which corresponds to the number n in the abovementioned formula (IXa). According to this nomenclature (known as the INCI nomenclature, CTFA International Cosmetic Ingredient Dictionary and Handbook, 5th Edition, The Cosmetic, Toiletry and Fragrance Association, Washington, 1997), for example, PEG-6, PEG-8, PEG-9, PEG-10, PEG-12, PEG-14, and PEG-16 can be used as the monomer unit. Polyethylene glycols are available commercially, for example, under the trade names Carbowax PEG (Union Carbide), Emkapol® (ICI Americas), Lipoxol® MED (HÜLS America), Polyglycol® E (Dow Chemical), Alkapol® PEG (Rhone-Poulenc), Lutrol® E (BASF).

Polypropylene glycols (abbreviation PPGS) are polymers of propylene glycol which satisfy the general formula (IXb)

$$H{-}(O{-}\underset{\underset{CH_3}{|}}{CH}{-}CH_2)_n{-}OH \quad \text{(IXb)}$$

in which n may adopt values between 5 and 2000.

Both in the case of compounds of the formula (IXa) and in the case of compounds of the formula (IXb) preferred monomer units are those representatives in which the number n stands for a number between 6 and 1500, preferably between 7 and 1200, with particular preference between 8 and 1000, with further preference between 9 and 500, and in particular between 10 and 200. For certain applications preference may be given to polyethylene and polypropylene glycols of the formula (IXa) and/or (IXb) in which n stands for a number between 15 and 150, preferably between 20 and 100, with particular preference between 25 and 75, and in particular between 30 and 60.

Examples of compounds which may optionally also be present in the reaction mixtures for preparing the polyurethanes are ethylene glycol, 1,2- and 1,3-propylene glycol, butylene glycols, ethylenediamine, propylenediamine, 1,4-diaminobutane, hexamethylene-diamine, and α,ω-diamines based on long-chain alkanes or polyalkylene oxides. Preference is given to polyurethanes which in the coating contain additional diamines, preferably hexamethylenediamine, and/or hydroxycarboxylic acids, preferably dimethylolpropionic acid.

Summarizing, particularly preferred polyurethanes are those composed of diisocyanates (VIII) and diols (IX)

$$O{=}C{=}N{-}R^4{-}N{=}C{=}O \quad \text{(VIII)},$$

$$H{-}O{-}R^5{-}O{-}H \quad \text{(IX)},$$

where $R^4$ is a methylene, ethylene, propylene, butylene, or pentylene group or is $-(CH_2)_6-$ or is 2,4- and/or 2,6-

$C_6H_3$—$CH_3$, or is $C_6H_4$—$CH_2$—$C_6H_4$ or is an isophorone radical (3,5,5-trimethyl-2-cyclohexenone) and $R^5$ is selected from —$CH_2$—$CH_2$—(O—$CH_2$—$CH_2$)$_n$— or —$CH_2$—$CH_2$—(O—CH($CH_3$)—$CH_2$)$_n$— with n=4 to 1999.

Depending on which reactants are reacted with one another to form the polyurethanes the polymers obtained have different structural units. Preferred structural units are depicted in the formula (X)

$$[O—C(O)—NH—R^4—NH—C(O)—O—R^5]_k— \quad (X),$$

in which $R^4$ is —$(CH_2)_6$— or is 2,4- and/or 2,6-$C_6H_3$—$CH_3$, or is $C_6H_4$—$CH_2$—$C_6H_4$, and $R^5$ is selected from —$CH_2$—$CH_2$—(O—$CH_2$—$CH_2$)$_n$— or —CH($CH_3$)—$CH_2$—(O—CH($CH_3$)—$CH_2$)$_n$—, where n is a number from 5 to 199 and k is a number from 1 to 2000.

In this context the diisocyanates described as being preferred can be reacted with all diols described as being preferred to form polyurethanes, so that polyurethanes used with preference possess one or more of the structural units (Xa) to (Xh):

$$—[O—C(O)—NH—CH_2)_6—NH—(O)—CH_2CH_2—(O—CH_2—CH_2)_n]_k— \quad (Xa),$$

$$—[O—C(O)—NH-(2,4-C_6H_3—CH_3)—NH—C(O)—O—CH_2—CH_2—(O—CH_2—CH_2)_n]_k— \quad (Xb),$$

$$—[O—C(O)—NH-(2,6-C_6H_3—CH_3)—NH—C(O)—O—CH_2—CH_2—(O—CH_2—CH_2)_n]_k— \quad (Xc),$$

$$—[O—C(O)—NH—(C_6H_4—CH_2—CH_4)—NH—C(O)—O—CH_2—CH_2—(O—CH_2—CH_2)_n]_k— \quad (Xd),$$

$$—[O—C(O)—NH—(CH_2)_6—NH—C(O)—O—CH(CH_3)—CH_2—(O—CH(CH_3)—CH_2)_n]_k— \quad (Xe),$$

$$—[O—C(O)—NH-(2,4-C_6H_3—CH_3)—NH—C(O)—O—CH(CH_3)—CH_2—(O—CH(CH_3)—CH_2)_n]_k— \quad (Xf),$$

$$—[O—C(O)—NH-(2,6-C_6H_3—CH_3)—NH—C(O)—CH(CH_3)—CH_2—(O—CH(CH_3)—CH_2)_n]_k— \quad (Xg),$$

$$—[O—C(O)—NH—(C_6H_4—CH_2—C_6H_4)—NH—C(O)—O—CH(CH_3)—CH_2—(O—CH(CH_3)—CH_2)_n]_k— \quad (Xh),$$

where n is a number from 5 to 199 and k is a number from 1 to 2000.

As already mentioned above, the reaction mixtures may in addition to diisocyanates (VIII) and diols (IX) also contain further compounds from the group of the polyisocyanates (especially triisocyanates and tetraisocyanates) and also from the group of the polyols and/or diamines and/or polyamines. In particular, triols, tetrols, pentols, and hexols, and also diamines and triamines, may be present in the reaction mixtures. The presence of compounds having more than two "active" hydrogen atoms (all of the abovementioned classes of substances with the exception of the diamines) leads to partial crosslinking of the polyurethane reaction products and can produce advantageous properties such as, for example, control of the dissolution characteristics, abrasion stability or flexibility of the coating, process advantages during. the application of the coating, etc. The amount of such compounds having more than two "active" hydrogen atoms in the reaction mixture is normally less than 20% by weight of the reaction partners for the diisocyanates that are employed in total, preferably less than 15% by weight, and in particular less than 5% by weight.

Polyurethanes are incorporated into the coating especially when said coating is to be particularly resistant to mechanical stresses. The polyurethanes give the coating elasticity and stability and, in accordance with the amount of water-soluble polymers indicated above, can account for up to 50% by weight of the coatings.

A further group of suitable polymers are those known as LCST polymers. The LCST polymers are substances which have a better solubility at low temperatures than at higher temperatures. They are also known substances having a lower critical separation temperature or clouding temperature.

The LCST substances are preferably selected from alkylated and/or hydroxyalkylated polysaccharides, cellulose ethers, acrylamides, such as polyiso-propylacrylamide, copolymers of acrylamides, poly-vinylcaprolactam, copolymers of polyvinylcaprolactam, particularly those with polyvinylpyrrolidone, polyvinyl methyl ether, copolymers of polyvinyl methyl ether, and blends of these substances.

Examples of alkylated and/or hydroxyalkylated polysaccharides are hydroxypropylmethylcellulose (HPMC), ethyl (hydroxyethyl)cellulose (EHEC), hydroxypropylcellulose (HPC), methylcellulose (MC), propylcellulose (PC), carboxymethylmethylcellulose (CMMC), hydroxybutylcellulose (HBC), hydroxybutylmethylcellulose (HBMC), hydroxyethylcellulose (HEC), hydroxyethylcarboxymethylcellulose (HECMC), hydroxyethylethylcellulose (HEEC), hydroxypropylcellulose (HPC), hydroxypropylcarboxymethylcellulose (HPCMC), hydroxyethylmethylcellulose (HEMC), methylhydroxyethylcellulose (MHEC), methylhydroxyethylpropylcellulose (MHEPC), and mixtures thereof, preference being given to methylcellulose, methylhydroxyethylcellulose, and methylhydroxypropylcellulose, to hydroxypropylcellulose, and to MCs with a low degree of ethoxylation, or to mixtures of the above.

Further examples of LCST substances are mixtures of cellulose ethers with carboxymethylcellulose (CMC). Further polymers which exhibit a lower critical separation temperature in water and which are likewise suitable are polymers of mono- or di-N-alkylated acrylamides, such as isopropylacrylamide, copolymers of mono- or di-N-substituted acrylamides with acrylates and/or acrylic acids, or mixtures of interpenetrating networks of the abovementioned (co)polymers, copolymers of isopropylacrylamide and polyvinylcaprolactam. Also suitable are copolymers with ethylene oxide, such as ethylene oxide/propylene oxide copolymers and graft copolymers of alkylated acrylamides with polyethylene oxide, polymethacrylic acid, polyvinyl alcohol and copolymers thereof, polyvinyl methyl ether, certain proteins such as poly(VATGVV), a repeating unit in the natural protein elastin, and certain alginates. Mixtures of these polymers with salts, low molecular mass organic compounds or surfactants may likewise be used as LCST substance.

The coating material is preferably applied at elevated temperature, since the viscosity falls as the temperature rises and the formation of a uniform and thin coating film is made easier. Processes of the invention characterized in that the solution has a temperature above 30 to 300° C., preferably 35 to 90° C., more preferably 40 to 85° C., and in particular from 50 to 80° C. are preferred.

In one preferred embodiment the coating step can be followed by a subsequent drying step, preferably by means of hot air or infrared irradiation.

In order to shorten the drying time it is possible, where the coating material is used in the form of an aqueous solution, to admix further solvents of low volatility which are miscible with water. These solvents come in particular from the group of the alcohols, preference being given to ethanol, n-propanol, and iso-propanol. On grounds of cost, ethanol and iso-propanol are particularly advisable.

Other ingredients of the coating material can be, for example, dyes or fragrances or pigments. Such additives improve, for example, the visual or olfactory impression of the tablets coated in accordance with the invention. Dyes and fragrances have been described in detail above. Examples of suitable pigments include white pigments such as titanium dioxide or zinc sulfite, pearlescent pigments or color pigments, the latter being subdivisible into organic pigments and inorganic pigments. All said pigments, when used, are employed preferably in finely divided form, i.e., with average particle sizes of 100 $\mu$m or well below.

Even with small amounts of coating material, the laundry detergent and cleaning product tablets coated in accordance with the invention already have markedly improved properties. In the context of the present invention it is preferred for the amount of coating material to make up less than 1% by weight, preferably less than 0.5% by weight, and in particular less than 0.25% by weight of the overall weight of the coated tablet. Laundry detergent and cleaning product tablets wherein the weight ratio of uncoated tablet to coating is greater than 100 to 1, preferably greater than 250 to 1, and in particular greater than 500 to 1 are therefore preferred embodiments of the present invention.

As a result of the small amounts in which the abovementioned polymers already bring about a highly robust and advantageous coating of the laundry detergent and cleaning product tablets compressed beforehand it is possible to realize coating thicknesses which are small in comparison to the dimensions of the tablets. In preferred laundry detergent and cleaning product tablets the thickness of the coating on the tablet is from 0.1 to 500 $\mu$m, preferably from 0.5 to 250 $\mu$m, and in particular from 5 to 100 $\mu$m.

Above, the constituents of the coating of the tablets of the invention have been described in detail. Below, the constituents of the tablets per se, i.e., of the uncoated tablets, are described. These tablets are sometimes referred to below as "base tablets" in order to establish a verbal delimitation from the term "tablet" for the coated laundry detergent and cleaning product tablets of the invention; in some cases, however, the general term "tablet" is used. Since the present invention provides base tablets provided with a coating, the statements made below for the base tablets do of course also apply to laundry detergent and cleaning product tablets of the invention which meet the corresponding conditions, and vice versa.

The base tablets comprise, as essential constituents, builder(s) and surfactant(s). The base tablets of the invention may comprise all of the builders commonly used in laundry detergents and cleaning products, i.e., in particular, zeolites, silicates, carbonates, organic cobuilders, and—where there are no ecological prejudices against their use—phosphates as well.

Suitable crystalline, layered sodium silicates possess the general formula $NaMSi_xO_{2x+1}.yH_2O$, where M is sodium or hydrogen, x is a number from 1.9 to 4, y is a number from 0 to 20, and preferred values for x are 2, 3 or 4. Crystalline phyllosilicates of this kind are described, for example, in European Patent Application EP-A-0 164 514. Preferred crystalline phyllosilicates of the formula indicated are those in which M is sodium and x adopts the value 2 or 3. In particular, both β- and δ-sodium disilicates $Na_2Si_2O_5.yH_2O$ are preferred, β-sodium disilicate, for example, being obtainable by the process described in International Patent Application WO-A-91/08171.

It is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary washing properties. The retardation of dissolution relative to conventional amorphous sodium silicates may have been brought about in a variety of ways—for example, by surface treatment, compounding, compacting, or overdrying. In the context of this invention, the term "amorphous" also embraces "X-ray-amorphous". This means that in X-ray diffraction experiments the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield vague or even sharp diffraction maxima. The interpretation of this is that the products have microcrystalline regions with a size of from 10 to several hundred nm, values up to max. 50 nm and in particular up to max. 20 nm being preferred. So-called X-ray-amorphous silicates of this kind, which likewise possess retarded dissolution relative to the conventional waterglasses, are described, for example, in German Patent Application DE-A-44 00 024. Particular preference is given to compacted amorphous silicates, compounded amorphous silicates, and overdried X-ray-amorphous silicates.

The finely crystalline, synthetic zeolite used, containing bound water, is preferably zeolite A and/or P. A particularly preferred zeolite P is Zeolite MAP® (commercial product from Crosfield). Also suitable, however, are zeolite X and also mixtures of A, X and/or P. A product available commercially and able to be used with preference in the context of the present invention, for example, is a cocrystallizate of zeolite X and zeolite A (approximately 80% by weight zeolite X), which is sold by CONDEA Augusta S.p.A. under the brand name VEGOBOND AX® and may be described by the formula $$nNa_2O.(1-n)K_2O.Al_2O_3.(2-2.5)SiO_2.(3.5-5.5)H_2O.$$

The zeolite may be used either as a builder in a granular compound or as a kind of "powdering" for the entire mixture intended for compression, it being common to utilize both methods for incorporating the zeolite into the premix. Suitable zeolites have an average particle size of less than 10 $\mu$m (volume distribution; measurement method: Coulter counter) and contain preferably from 18 to 22% by weight, in particular from 20 to 22% by weight, of bound water.

Of course, the widely known phosphates may also be used as builder substances provided such a use is not to be avoided on ecological grounds. Among the large number of commercially available phosphates, the alkali metal phosphates, with particular preference being given to pentasodium and pentapotassium triphosphate (sodium and potassium tripolyphosphate, respectively), possess the greatest importance in the laundry detergent and cleaning product industry.

Alkali metal phosphates is the collective term for the alkali metal (especially sodium and potassium) salts of the various phosphoric acids, among which metaphosphoric acids $(HPO_3)_n$ and orthophosphoric acid $H_3PO_4$, in addition to higher-molecular-mass representatives, may be distinguished. The phosphates combine a number of advantages: they act as alkali carriers, prevent limescale deposits on machine components, and lime incrustations on fabrics, and additionally contribute to cleaning performance.

Sodium dihydrogen phosphate, $NaH_2PO_4$, exists as the dihydrate (density 1.91 g $cm^{-3}$, melting point 600) and as the monohydrate (density 2.04 g $cm^{-3}$). Both salts are white powders of very ready solubility in water which lose the water of crystallization on heating and undergo conversion at 200° C. into the weakly acidic diphosphate (disodium hydrogen diphosphate, $Na_2H_2P_2O_7$) and at the higher temperature into sodium trimetaphosphate ($Na_3P_3O_9$) and Maddrell's salt (see below). $NaH_2PO_4$ reacts acidically; it is formed if phosphoric acid is adjusted to a pH of 4.5 using sodium hydroxide solution and the slurry is sprayed. Potassium dihydrogen phosphate (primary or monobasic potassium phosphate, potassium biphosphate, PDP), $KH_2PO_4$, is a white salt with a density of 2.33 g $cm^{-3}$, has a melting point of 253° [decomposition with formation of potassium polyphosphate $(KPO_3)_x$], and is readily soluble in water.

Disodium hydrogen phosphate (secondary sodium phosphate), $Na_2HPO_4$, is a colorless, crystalline salt which is very readily soluble in water. It exists in anhydrous form and with 2 mol (density 2.066 g $cm^{-3}$, water loss at 95°), 7 mol (density 1.68 g $cm^{-3}$, melting point 48° with loss of $5H_2O$), and 12 mol of water (density 1.52 g $cm^{-3}$, melting point 35° with loss of $5H_2O$), becomes anhydrous at 100°, and if heated more severely undergoes transition to the diphosphate $Na_4P_2O_7$. Disodium hydrogen phosphate is prepared by neutralizing phosphoric acid with sodium carbonate solution using phenolphthalein as indicator. Dipotassium hydrogen phosphate (secondary or dibasic potassium phosphate), $K_2HPO_4$, is an amorphous white salt which is readily soluble in water.

Trisodium phosphate, tertiary sodium phosphate, $Na_3PO_4$, exists as colorless crystals which as the dodecahydrate have a density of 1.62 g $cm^{-3}$ and a melting point of 73–76° C. (decomposition), as the decahydrate (corresponding to 19–20% $P_2O_5$) have a melting point of 100° C., and in anhydrous form (corresponding to 39–40% $P_2O_5$) have a density of 2.536 g $cm^{-3}$. Trisodium phosphate is readily soluble in water, with an alkaline reaction, and is prepared by evaporative concentration of a solution of precisely 1 mol of disodium phosphate and 1 mol of NaOH. Tripotassium phosphate (tertiary or tribasic potassium phosphate), $K_3PO_4$, is a white, deliquescent, granular powder of density 2.56 g $cm^{-3}$, has a melting point of 1340°, and is readily soluble in water with an alkaline reaction. It is produced, for example, when Thomas slag is heated with charcoal and potassium sulfate. Despite the relatively high price, the more readily soluble and therefore highly active potassium phosphates are frequently preferred in the cleaning products industry over the corresponding sodium compounds.

Tetrasodium diphosphate (sodium pyrophosphate), $Na_4P_2O_7$, exists in anhydrous form (density 2.534 g $cm^{-3}$, melting point 988°, 880° also reported) and as the decahydrate (density 1.815–1.836 g $cm^{-3}$, melting point 94° with loss of water). As substances are colorless crystals which dissolve in water with an alkaline reaction. $Na_4P_2O_7$ is formed when disodium phosphate is heated at >200° or by reacting phosphoric acid with sodium carbonate in stoichiometric ratio and dewatering the solution by spraying. The decahydrate complexes heavy metal salts and water hardeners and therefore reduces the hardness of the water. Potassium diphosphate (potassium pyrophosphate), $K_4P_2O_7$, exists in the form of the trihydrate and is a colorless, hygroscopic powder of density 2.33 g $cm^{-3}$ which is soluble in water, the pH of the 1% strength solution at 25° being 10.4.

Condensation of $NaH_2PO_4$ or of $KH_2PO_4$ gives rise to higher-molecular-mass sodium and potassium phosphates, among which it is possible to distinguish cyclic representatives, the sodium and potassium metaphosphates, and catenated types, the sodium and potassium polyphosphates. For the latter in particular a large number of names are in use: fused or calcined phosphates, Graham's salt, Kurrol's and Maddrell's salt. All higher sodium and potassium phosphates are referred to collectively as condensed phosphates.

The industrially important pentasodium triphosphate, $Na_5P_3O_{10}$ (sodium tripolyphosphate), is a nonhygroscopic, white, water-soluble salt which is anhydrous or crystallizes with $6H_2O$ and has the general formula NaO—[P(O)(ONa)—O]$_n$—Na where n=3. About 17 g of the anhydrous salt dissolve in 100 g of water at room temperature, at 60° about 20 g, at 100° around 32 g; after heating the solution at 100° C. for two hours, about 8% orthophosphate and 15% diphosphate are produced by hydrolysis. For the preparation of pentasodium triphosphate, phosphoric acid is reacted with sodium carbonate solution or sodium hydroxide solution in stoichiometric ratio and the solution is dewatered by spraying. In a similar way to Graham's salt and sodium diphosphate, pentasodium triphosphate dissolves numerous insoluble metal compounds (including lime soaps, etc). Pentapotassium triphosphate, $K_5P_3O_{10}$ (potassium tripolyphosphate), is commercialized, for example, in the form of a 50% strength by weight solution (>23% $P_2O_5$, 25% $K_2O$). The potassium polyphosphates find broad application in the laundry detergents and cleaning products industry. There also exist sodium potassium tripolyphosphates, which may likewise be used for the purposes of the present invention. These are formed, for example, when sodium trimetaphosphate is hydrolyzed with KOH:

$$(NaPO_3)_3+2KOH \rightarrow Na_3K_2P_3O_{10}+H_2O$$

They can be used in accordance with the invention in precisely the same way as sodium tripolyphospate, potassium tripolyphosphate, or mixtures of these two; mixtures of sodium tripolyphosphate and sodium potassium tripolyphosphate, or mixtures of potassium tripolyphosphate and sodium potassium tripolyphosphate, or mixtures of sodium tripolyphosphate and potassium tripolyphosphate and sodium potassium tripolyphospate, may also be used in accordance with the invention.

Organic cobuilders which may be used in the base tablets of the invention are, in particular, polycarboxylates/polycarboxylic acids, polymeric polycarboxylates, aspartic acid, polyacetals, dextrins, further organic cobuilders (see below), and phosphonates. These classes of substance are described below.

Organic builder substances which may be used are, for example, the polycarboxylic acids, usable in the form of their sodium salts, the term polycarboxylic acids meaning those carboxylic acids which carry more than one acid function. Examples of these are citric acid, adipic acid, succinic acid, glutaric acid, malic acid, tartaric acid, maleic acid, fumaric acid, sugar acids, amino carboxylic acids, nitrilotriacetic acid (NTA), provided such use is not objectionable on ecological grounds, and also mixtures thereof. Preferred salts are the salts of the polycarboxylic acids such as citric acid, adipic acid, succinic acid, glutaric acid, tartaric acid, sugar acids, and mixtures thereof.

The acids per se may also be used. In addition to their builder effect, the acids typically also possess the property of an acidifying component and thus also serve to establish a lower and milder pH of laundry detergents or cleaning products. In this context, mention may be made in particular of citric acid, succinic acid, glutaric acid, adipic acid, gluconic acid, and any desired mixtures thereof.

Also suitable as builders are polymeric polycarboxylates; these are, for example, the alkali metal salts of polyacrylic acid or of polymethacrylic acid, examples being those having a relative molecular mass of from 500 to 70,000 g/mol.

The molecular masses reported for polymeric polycarboxylates, for the purposes of this document, are weight-average molecular masses, $M_w$, of the respective acid form, determined basically by means of gel permeation chromatography (GPC) using a UV detector. The measurement was made against an external polyacrylic acid standard, which owing to its structural similarity to the polymers under investigation provides realistic molecular weight values. These figures differ markedly from the molecular weight values obtained using polystyrenesulfonic acids as the standard. The molecular masses measured against polystyrenesulfonic acids are generally much higher than the molecular masses reported in this document.

Suitable polymers are, in particular, polyacrylates, which preferably have a molecular mass of from 2000 to 20,000 g/mol. Owing to their superior solubility, preference in this group may be given in turn to the short-chain polyacrylates, which have molecular masses of from 2000 to 10,000 g/mol, and with particular preference from 3000 to 5000 g/mol.

Also suitable are copolymeric polycarboxylates, especially those of acrylic acid with methacrylic acid and of acrylic acid or methacrylic acid with maleic acid. Copolymers which have been found particularly suitable are those of acrylic acid with maleic acid which contain from 50 to 90% by weight acrylic acid and from 50 to 10% by weight maleic acid. Their relative molecular mass, based on free acids, is generally from 2000 to 70,000 g/mol, preferably from 20,000 to 50,000 g/mol, and in particular from 30,000 to 40,000 g/mol.

The (co)polymeric polycarboxylates can be used either as powders or as aqueous solutions. The (co)polymeric polycarboxylate content of the compositions is preferably from 0.5 to 20% by weight, in particular from 3 to 10% by weight.

In order to improve the solubility in water, the polymers may also contain allylsulfonic acids, such as allyloxybenzenesulfonic acid and methallylsulfonic acid, for example, as monomers.

Particular preference is also given to biodegradable polymers comprising more than two different monomer units, examples being those comprising, as monomers, salts of acrylic acid and of maleic acid, and also vinyl alcohol or vinyl alcohol derivatives, or those comprising, as monomers, salts of acrylic acid and of 2-alkylallylsulfonic acid, and also sugar derivatives.

Further preferred copolymers are those described in German Patent Applications DE-A-43 03 320 and DE-A-44 17 734, whose monomers are preferably acrolein and acrylic acid/acrylic acid salts, and, respectively, acrolein and vinyl acetate.

Similarly, further preferred builder substances that may be mentioned include polymeric amino dicarboxylic acids, their salts or their precursor substances. Particular preference is given to polyaspartic acids and their salts and derivatives, which are disclosed in German Patent Application DE-A-195 40 086 to have not only cobuilder properties but also a bleach-stabilizing action.

Further suitable builder substances are polyacetals, which may be obtained by reacting dialdehydes with polyol carboxylic acids having 5 to 7 carbon atoms and at least 3 hydroxyl groups. Preferred polyacetals are obtained from dialdehydes such as glyoxal, glutaraldehyde, terephthalaldehyde and mixtures thereof and from polyol carboxylic acids such as gluconic acid and/or glucoheptonic acid.

Further suitable organic builder substances are dextrins, examples being oligomers and polymers of carbohydrates, which may be obtained by partial hydrolysis of starches. The hydrolysis can be conducted by customary processes; for example, acid-catalyzed or enzyme-catalyzed processes. The hydrolysis products preferably have average molecular masses in the range from 400 to 500,000 g/mol. Preference is given here to a polysaccharide having a dextrose equivalent (DE) in the range from 0.5 to 40, in particular from 2 to 30, DE being a common measure of the reducing effect of a polysaccharide in comparison to dextrose, which possesses a DE of 100. It is possible to use both maltodextrins having a DE of between 3 and 20 and dried glucose syrups having a DE of between 20 and 37, and also so-called yellow dextrins and white dextrins having higher molecular masses, in the range from 2000 to 30,000 g/mol.

The oxidized derivatives of such dextrins comprise their products of reaction with oxidizing agents which are able to oxidize at least one alcohol function of the saccharide ring to the carboxylic acid function. Oxidized dextrins of this kind, and processes for preparing them, are known, for example, from European Patent Applications EP-A-0 232 202, EP-A-0 427 349, EP-A-0 472 042 and EP-A-0 542 496 and from International Patent Applications wo 92/18542, WO 93/08251, WO 93/16110, WO 94/28030, WO 95/07303, WO 95/12619 and WO 95/20608. Likewise suitable is an oxidized oligosaccharide in accordance with German Patent Application DE-A-196 00 018. A product oxidized at $C_6$ of the saccharide ring may be particularly advantageous.

Oxydisuccinates and other derivatives of disuccinates, preferably ethylenediamine disuccinate, are further suitable cobuilders. Ethylenediamine N,N'-disuccinate (EDDS) is used preferably in the form of its sodium or magnesium salts. Further preference in this context is given to glycerol disuccinates and glycerol trisuccinates as well. Suitable use amounts in formulations containing zeolite and/or silicate are from 3 to 15% by weight.

Examples of further useful organic cobuilders are acetylated hydroxy carboxylic acids and their salts, which may also be present in lactone form and which contain at least 4 carbon atoms, at least one hydroxyl group, and not more than two acid groups. Such cobuilders are described, for example, in International Patent Application WO 95/20029.

A further class of substance having cobuilder properties is represented by the phosphonates. The phosphonates in question are, in particular, hydroxyalkane- and aminoalkanephosphonates. Among the hydroxyalkanephosphonates, 1-hydroxyethane-1,1-diphosphonate (HEDP) is of particular importance as a cobuilder. It is used preferably as the sodium salt, the disodium salt being neutral and the tetrasodium salt giving an alkaline (pH 9) reaction. Suitable aminoalkanephosphonates are preferably ethylenediamine- tetramethylenephosphonate (EDTMP), diethylenetriaminepentamethylenephosphonate (DTPMP), and their higher homologs. They are used preferably in the form of the neutrally reacting sodium salts, e.g., as the hexasodium salt of EDTMP or as the hepta- and octa-sodium salt of DTPMP. As a builder in this case, preference is given to using HEDP from the class of the phosphonates. Furthermore, the aminoalkanephosphonates possess a pronounced heavy metal binding capacity. Accordingly, and especially if the compositions also contain bleach, it may be preferred to use aminoalkanephosphonates, expecially DTPMP, or to use mixtures of said phosphonates.

Furthermore, all compounds capable of forming complexes with alkaline earth metal ions may be used as cobuilders.

The amount of builder is usually between 10 and 70% by weight, preferably between 15 and 60% by weight, and in particular between 20 and 50% by weight. In turn, the amount of builders used is dependent on the intended use, so that bleach tablets may contain higher amounts of builders (for example, between 20 and 70% by weight, preferably between 25 and 65% by weight, and in particular between 30 and 55% by weight) than, say, laundry detergent tablets (usually from 10 to 50% by weight, preferably from 12.5 to 45% by weight, and in particular between 17.5 and 37.5% by weight).

Preferred base tablets further comprise one or more surfactants. In the base tablets it is possible to use anionic, nonionic, cationic and/or amphoteric surfactants, and/or mixtures thereof. From a performance standpoint, preference is given to mixtures of anionic and nonionic surfactants. The total surfactant content of the tablets is from 5 to 60% by weight, based on the tablet weight, preference being given to surfactant contents of more than 15% by weight.

Anionic surfactants used are, for example, those of the sulfonate and sulfate type. Preferred surfactants of the sulfonate type are $C_{9-13}$ alkylbenzenesulfonates, olefinsulfonates, i.e., mixtures of alkenesulfonates and hydroxyalkanesulfonates, and also disulfonates, as are obtained, for example, from $C_{12-18}$ monoolefins having a terminal or internal double bond by sulfonating with gaseous sulfur trioxide followed by alkaline or acidic hydrolysis of the sulfonation products. Also suitable are alkanesulfonates, which are obtained from $C_{12-18}$ alkanes, for example, by sulfochlorination or sulfoxidation with subsequent hydrolysis or neutralization, respectively. Likewise suitable, in addition, are the esters of α-sulfo fatty acids (ester sulfonates), e.g., the α-sulfonated methyl esters of hydrogenated coconut, palm kernel or tallow fatty acids.

Further suitable anionic surfactants are sulfated fatty acid glycerol esters. Fatty acid glycerol esters are the monoesters, diesters and triesters, and mixtures thereof, as obtained in the preparation by esterification of a monoglycerol with from 1 to 3 mol of fatty acid or in the transesterification of triglycerides with from 0.3 to 2 mol of glycerol. Preferred sulfated fatty acid glycerol esters are the sulfation products of saturated fatty acids having 6 to 22 carbon atoms, examples being those of caproic acid, caprylic acid, capric acid, myristic acid, lauric acid, palmitic acid, stearic acid, or behenic acid.

Preferred alk(en)yl sulfates are the alkali metal salts, and especially the sodium salts, of the sulfuric monoesters of $C_{12}$–$C_{18}$ fatty alcohols, examples being those of coconut fatty alcohol, tallow fatty alcohol, lauryl, myristyl, cetyl or stearyl alcohol, or of $C_{10}$–$C_{20}$ oxo alcohols, and those monoesters of secondary alcohols of these chain lengths. Preference is also given to alk(en)yl sulfates of said chain length which contain a synthetic straight-chain alkyl radical prepared on a petrochemical basis, these sulfates possessing degradation properties similar to those of the corresponding compounds based on fatty-chemical raw materials. From a detergents standpoint, the $C_{12}$–$C_{16}$ alkyl sulfates and $C_{12}$–$C_{15}$ alkyl sulfates, and also $C_{14}$–$C_{15}$ alkyl sulfates, are preferred. In addition, 2,3-alkyl sulfates, which may for example be prepared in accordance with U.S. Pat. Nos. 3,234,258 or 5,075,041 and obtained as commercial products from Shell Oil Company under the name DAN®, are suitable anionic surfactants.

Also suitable are the sulfuric monoesters of the straight-chain or branched $C_{7-21}$ alcohols ethoxylated with from 1 to 6 mol of ethylene oxide, such as 2-methyl-branched $C_{9-11}$ alcohols containing on average 3.5 mol of ethylene oxide (EO) or $C_{12-18}$ fatty alcohols containing from 1 to 4 EO. Because of their high foaming behavior they are used in cleaning products only in relatively small amounts, for example, in amounts of from 1 to 5% by weight.

Further suitable anionic surfactants include the salts of alkylsulfosuccinic acid, which are also referred to as sulfosuccinates or as sulfosuccinic esters and which constitute monoesters and/or diesters of sulfosuccinic acid with alcohols, preferably fatty alcohols and especially ethoxylated fatty alcohols. Preferred sulfosuccinates comprise $C_{8-18}$ fatty alcohol radicals or mixtures thereof. Especially preferred sulfosuccinates contain a fatty alcohol radical derived from ethoxylated fatty alcohols which themselves represent nonionic surfactants (for description, see below). Particular preference is given in turn to sulfosuccinates whose fatty alcohol radicals are derived from ethoxylated fatty alcohols having a narrowed homolog distribution. Similarly, it is also possible to use alk(en)ylsuccinic acid containing preferably 8 to 18 carbon atoms in the alk(en)yl chain, or salts thereof.

Further suitable anionic surfactants are, in particular, soaps. Suitable soaps include saturated fatty acid soaps, such as the salts of lauric acid, myristic acid, palmitic acid, stearic acid, hydrogenated erucic acid and behenic acid, and, in particular, mixtures of soaps derived from natural fatty acids, e.g., coconut, palm kernel, or tallow fatty acids.

The anionic surfactants, including the soaps, may be present in the form of their sodium, potassium or ammonium salts and also as soluble salts of organic bases, such as mono-, di- or triethanolamine. Preferably, the anionic surfactants are in the form of their sodium or potassium salts, in particular in the form of the sodium salts.

Nonionic surfactants used are preferably alkoxylated, advantageously ethoxylated, especially primary, alcohols having preferably 8 to 18 carbon atoms and on average from 1 to 12 mol of ethylene oxide (EO) per mole of alcohol, in which the alcohol radical may be linear or, preferably, methyl-branched in position 2 and/or may comprise linear and methyl-branched radicals in a mixture, as are commonly present in oxo alcohol radicals. In particular, however, preference is given to alcohol ethoxylates containing linear radicals from alcohols of natural origin having 12 to 18 carbon atoms, e.g., from coconut, palm, tallow fatty or oleyl alcohol and on average from 2 to 8 EO per mole of alcohol. Preferred ethoxylated alcohols include, for example, $C_{12-14}$ alcohols containing 3 EO or 4 EO, $C_{9-11}$ alcohol containing 7 EO, $C_{13-15}$ alcohols containing 3 EO, 5 EO, 7 EO or 8 EO, C12-18 alcohols containing 3 EO, 5 EO or 7 EO, and mixtures thereof, such as mixtures of $C_{12-14}$ alcohol containing 3 EO and $C_{12-18}$ alcohol containing 5 EO. The stated degrees of ethoxylation represent statistical mean values, which for a specific product may be an integer or a fraction. Preferred alcohol ethoxylates have a narrowed homolog distribution (narrow range ethoxylates, NREs). In addition to these nonionic surfactants it is also possible to use fatty alcohols containing more than 12 EO. Examples thereof are tallow fatty alcohol containing 14 EO, 25 EO, 30 EO or 40 EO.

As further nonionic surfactants, furthermore, use may also be made of alkyl glycosides of the general formula $RO(G)_x$, where R is a primary straight-chain or methyl-branched aliphatic radical, especially an aliphatic radical methyl-branched in position 2, containing 8 to 22, preferably 12 to 18, carbon atoms, and G is the symbol representing a glycose unit having 5 or 6 carbon atoms, preferably glucose. The degree of oligomerization, x, which indicates the distribution of monoglycosides and oligoglycosides, is any desired number between 1 and 10; preferably, x is from 1.2 to 1.4.

A further class of nonionic surfactants used with preference, which are used either as sole nonionic surfactant or in combination with other nonionic surfactants, are alkoxylated, preferably ethoxylated, or ethoxylated and propoxylated, fatty acid alkyl esters, preferably having 1 to 4 carbon atoms in the alkyl chain, especially fatty acid methyl esters, as are described, for example, in Japanese Patent Application JP 58/217598, or those prepared preferably by the process described in International Patent Application WO-A-90/13533.

Nonionic surfactants of the amine oxide type, examples being N-cocoalkyl-N,N-dimethylamine oxide and N-tallowalkyl-N,N-dihydroxyethylamine oxide, and of the fatty acid alkanolamide type, may be also be suitable. The amount of these nonionic surfactants is preferably not more than that of the ethoxylated fatty alcohols, in particular not more than half thereof.

Further suitable surfactants are polyhydroxy fatty acid amides of the formula (IX),

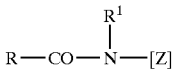

(IX)

where RCO is an aliphatic acyl radical having 6 to 22 carbon atoms, $R^1$ is hydrogen or an alkyl or hydroxyalkyl radical having 1 to 4 carbon atoms, and [Z] is a linear or branched polyhydroxyalkyl radical having 3 to 10 carbon atoms and from 3 to 10 hydroxyl groups. The polyhydroxy fatty acid amides are known substances which are customarily obtainable by reductive amination of a reducing sugar with ammonia, an alkylamine or an alkanolamine, and subsequent acylation with a fatty acid, a fatty acid alkyl ester or a fatty acid chloride.

The group of the polyhydroxy fatty acid amides also includes compounds of the formula (XI)

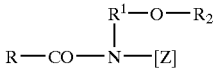

(XI)

where R is a linear or branched alkyl or alkenyl radical having 7 to 12 carbon atoms, $R^1$ is a linear, branched or cyclic alkyl radical or an aryl radical having 2 to 8 carbon atoms and $R^2$ is a linear, branched or cyclic alkyl radical or an aryl radical or an oxyalkyl radical having 1 to 8 carbon atoms, preference being given to $C_{1-4}$ alkyl radicals or phenyl radicals, and [Z] is a linear polyhydroxyalkyl radical whose alkyl chain is substituted by at least two hydroxyl groups, or alkoxylated, preferably ethoxylated or propoxylated, derivatives of said radical.

[Z] is preferably obtained by reductive amination of a reduced sugar, e.g., glucose, fructose, maltose, lactose, galactose, mannose, or xylose. The N-alkoxy- or N-aryloxy-substituted compounds may then be converted to the desired polyhydroxy fatty acid amides, for example, in accordance with the teaching of International Patent Application WO-A-95/07331 by reaction with fatty acid methyl esters in the presence of an alkoxide as catalyst.

In the context of the present invention, preference is given to base tablets comprising anionic and nonionic surfactant (s); performance advantages may result from certain proportions in which the individual classes of surfactant are used.

For example, particular preference is given to base tablets in which the ratio of anionic surfactant(s) to nonionic surfactant(s) is between 10:1 and 1:10, preferably between 7.5:1 and 1:5, and in particular between 5:1 and 1:2. Preference is also given to laundry detergent and cleaning product tablets which comprise anionic and/or nonionic surfactant(s) and have total surfactant contents of more than 2.5% by weight, preferably more than 5% by weight, and in particular more than 10% by weight, based in each case on the tablet weight. Particularly preferred are laundry detergent and cleaning product tablets comprising surfactant(s), preferably anionic and/or nonionic surfactant(s), in amounts of from 5 to 40% by weight, preferably from 7.5 to 35% by weight, with particular preference from 10 to 30% by weight, and in particular from 12.5 to 25% by weight, based in each case on the tablet weight.

From a performance standpoint it may be advantageous if certain classes of surfactant are absent from some phases of the base tablets or from the tablet as a whole, i.e., from all phases. A further important embodiment of the present invention therefore envisages that at least one phase of the tablets is free from nonionic surfactants.

Conversely, however, the presence of certain surfactants in individual phases or in the whole tablet, i.e., in all phases, may produce a positive effect. The incorporation of the above-described alkyl polyglycosides has been found advantageous, and so preference is given to base tablets in which at least one phase of the tablets comprises alkyl polyglycosides.

Similarly to the case with the nonionic surfactants, the omission of anionic surfactants from certain phases or all phases may also result in base tablets better suited to certain fields of application. In the context of the present invention, therefore, it is also possible to conceive of laundry detergent and cleaning product tablets in which at least one phase of the tablets is free from anionic surfactants.

In order to facilitate the disintegration of highly compacted tablets, it is possible to incorporate disintegration aids, known as tablet disintegrants, into the tablets in order to reduce the disintegration times. Tablet disintegrants, or disintegration accelerators, are understood in accordance with Römpp (9th Edition, Vol. 6, p. 4440) and Voigt "*Lehrbuch der pharmazeutischen Technologie*" [Textbook of pharmaceutical technology] (6th Edition, 1987, pp. 182–184) to be auxiliaries which ensure the rapid disintegration of tablets in water or gastric fluid and the release of the drugs in absorbable form.

These substances increase in volume on ingress of water, with on the one hand an increase in the intrinsic volume (swelling) and on the other hand, by way of the release of gases, the generation of a pressure which causes the tablets to disintegrate into smaller particles. Examples of established disintegration aids are carbonate/citric acid systems, with the use of other organic acids also being possible. Examples of swelling disintegration aids are synthetic polymers such as polyvinylpyrrolidone (PVP) or natural polymers and/or modified natural substances such as cellulose and starch and their derivatives, alginates, or casein derivatives.

Preferred base tablets contain from 0.5 to 10% by weight, preferably from 3 to 7% by weight, and in particular from 4 to 6% by weight, of one or more disintegration aids, based in each case on the tablet weight.

Preferred disintegrants used in the context of the present invention are cellulose-based disintegrants and so preferred base tablets comprise a cellulose-based disintegrant of this kind in amounts from 0.5 to 10% by weight, preferably from 3 to 7% by weight, and in particular from 4 to 6% by weight. Pure cellulose has the formal empirical composition $(C_6H_{10}O_5)_n$ and, considered formally, is a β-1,4-polyacetal of cellobiose, which itself is constructed of two molecules of glucose. Suitable celluloses consist of from about 500 to 5000 glucose units and, accordingly, have average molecular masses of from 50,000 to 500,000. Cellulose-based disintegrants which can be used also include, in the context of the present invention, cellulose derivatives obtainable by polymer-analogous reactions from cellulose. Such chemically modified celluloses include, for example, products of esterifications and etherifications in which hydroxy hydrogen atoms have been substituted. However, celluloses in which the hydroxyl groups have been replaced by functional groups not attached by an oxygen atom may also be used as cellulose derivatives. The group of the cellulose derivatives embraces, for example, alkali metal celluloses, carboxymethyl-cellulose (CMC), cellulose esters and cellulose ethers and aminocelluloses. Said cellulose derivatives are preferably not used alone as cellulose-based disintegrants but instead are used in a mixture with cellulose. The cellulose derivative content of these mixtures is preferably less than 50% by weight, with particular preference less than 20% by weight, based on the cellulose-based disintegrant. The particularly preferred cellulose-based disintegrant used is pure cellulose, free from cellulose derivatives.

The cellulose used as disintegration aid is preferably not used in finely divided form but instead is converted into a coarser form, for example, by granulation or compaction, before being admixed to the premixes intended for compression. Laundry detergent and cleaning product tablets comprising disintegrants in granular or optionally cogranulated form are described in German Patent Applications DE 197 09 991 (Stefan Herzog) and DE 197 10 254 (Henkel) and in International Patent Application WO98/40463 (Henkel). These documents also provide further details on the production of granulated, compacted or cogranulated cellulose disintegrants. The particle sizes of such disintegrants are usually above 200 μm, preferably between 300 and 1600 μm to the extent of at least 90%, and in particular between 400 and 1200 μm to the extent of at least 90%. The abovementioned, relatively coarse cellulose-based disintegration aids, and those described in more detail in the cited documents, are preferred for use as cellulose-based disintegration aids in the context of the present invention and are available commercially, for example, under the designation Arbocel® TF-30-HG from the company Rettenmaier.

As a further cellulose-based disintegrant or as a constituent of this component it is possible to use microcrystalline cellulose. This microcrystalline cellulose is obtained by partial hydrolysis of celluloses under conditions which attack only the amorphous regions (approximately 30% of the total cellulose mass) of the celluloses and break them up completely but leave the crystalline regions (approximately 70%) intact. Subsequent deaggregation of the microfine celluloses resulting from the hydrolysis yields the microcrystalline celluloses, which have primary particle sizes of approximately 5 μm and can be compacted, for example, to granules having an average particle size of 200 μm.

Laundry detergent and cleaning product tablets which are preferred in the context of the present invention further comprise a disintegration aid, preferably a cellulose-based disintegration aid, preferably in granular, cogranulated or compacted form, in amounts of from 0.5 to 10% by weight, preferably from 3 to 7% by weight, and in particular from 4 to 6% by weight, based in each case on the tablet weight, with preferred disintegration aids having average particle sizes of more than 300 μm, preferably more than 400 μm, and in particular more than 500 μm.

In addition to the abovementioned constituents—builder, surfactant and disintegration aid—the laundry detergent and cleaning product tablets to be coated in accordance with the invention may further comprise further customary laundry detergent and cleaning product ingredients from the group consisting of bleaches, bleach activators, dyes, fragrances, optical brighteners, enzymes, foam inhibitors, silicone oils, antiredeposition agents, graying inhibitors, color transfer inhibitors, and corrosion inhibitors.

In order to develop the desired bleaching performance, the laundry detergent and cleaning product tablets of the present invention may comprise bleaches. In this context, the customary bleaches from the group consisting of sodium perborate monohydrate, sodium perborate tetrahydrate, and sodium percarbonate have proven particularly appropriate.

"Sodium percarbonate" is a term used unspecifically for sodium carbonate peroxohydrates, which strictly speaking are not "percarbonates" (i.e., salts of percarbonic acid) but rather hydrogen peroxide adducts onto sodium carbonate. The commercial product has the average composition 2 $Na_2CO_3.3H_2O_2$ and is thus not a peroxycarbonate. Sodium percarbonate forms a white, water-soluble powder of density 2.14 g $cm^{-3}$ which breaks down readily into sodium carbonate and oxygen having a bleaching or oxidizing action.

Sodium carbonate peroxohydrate was first obtained in 1899 by precipitation with ethanol from a solution of sodium carbonate in hydrogen peroxide, but was mistakenly regarded as a peroxycarbonate. Only in 1909 was the compound recognized as the hydrogen peroxide addition compound; nevertheless, the historical name (sodium percarbonate) has persisted in the art.

Industrially, sodium percarbonate is produced predominantly by precipitation from aqueous solution (known as the wet process). In this process, aqueous solutions of sodium carbonate and hydrogen peroxide are combined and the sodium percarbonate is precipitated by means of salting agents (predominantly sodium chloride), crystallizing aids (for example poly-phosphates, polyacrylates), and stabilizers (for example, $Mg^{2+}$ ions). The precipitated salt, which still contains from 5 to 12% by weight of the mother liquor, is subsequently centrifuged and dried in fluidized-bed driers at 90° C. The bulk density of the finished product may vary between 800 and 1200 g/l according to the production process. Generally, the percarbonate is stabilized by an additional coating. Coating processes, and substances used for the coating, are amply described in the patent literature. Fundamentally, it is possible in accordance with the invention to use all commercially customary percarbonate types, as supplied, for example, by the companies Solvay Interox, Degussa, Kemira or Akzo.

In the context of the bleaches used, the amount of these substances in the tablets is dependent on the intended use of the tablets. Whereas customary universal laundry detergents in tablet form contain between 5 and 30% by weight, preferably between 7.5 and 25% by weight, and in particular between 12.5 and 22.5% by weight, of bleach, the amounts in the case of bleach tablets or bleach booster tablets are between 15 and 50% by weight, preferably between 22.5 and 45% by weight, and in particular between 30 and 40% by weight.

In addition to the bleaches used, the laundry detergent and cleaning product tablets of the invention may comprise bleach activator(s), which is preferred in the context of the present invention. Bleach activators are incorporated into laundry detergents and cleaning products in order to achieve an improved bleaching activity when washing at temperatures of 60° C. or below. Bleach activators which may be used are compounds which under perhydrolysis conditions give rise to aliphatic peroxocarboxylic acids having preferably 1 to 10 carbon atoms, in particular 2 to 4 carbon atoms, and/or substituted or unsubstituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, especially tetraacetylethylenediamine (TAED), acylated triazine derivatives, especially 1,5-diacetyl-2,4-dioxohexa-hydro-1,3,5-triazine (DADHT), acylated glycolurils, especially tetraacetylglycoluril (TAGU), N-acylimides, especially N-nonanoylsuccinimide (NOSI), acylated phenolsulfonates, especially n-nonanoyl- or iso-nonanoyloxybenzenesulfonate (n- or iso-NOBS), carboxylic anhydrides, especially phthalic anhydride, acylated polyhydric alcohols, especially triacetin, ethylene glycol diacetate, and 2,5-diacetoxy-2,5-dihydrofuran.

In addition to the conventional bleach activators, or instead of them, it is also possible to incorporate what are known as bleaching catalysts into the tablets. These substances are bleach-boosting transition metal salts or transition metal complexes such as, for example, Mn-, Fe-, Co-, Ru- or Mo-salen complexes or -carbonyl complexes. Other bleaching catalysts which can be used include Mn, Fe, Co, Ru, Mo, Ti, V and Cu complexes with N-containing tripod ligands, and also Co-, Fe-, Cu- and Ru-ammine complexes.

If the tablets of the invention comprise bleach activators, they contain, in each case based on the total tablet, between 0.5 and 30% by weight, preferably between 1 and 20% by weight, and in particular between 2 and 15%, of one or more bleach activators or bleaching catalysts. Depending on the intended use of the tablets produced, these amounts may vary. Thus in typical universal laundry detergent tablets, bleach activator contents of between 0.5 and 10% by weight, preferably between 2 and 8% by weight, and in particular between 4 and 6% by weight, are customary, whereas bleach tablets may have consistently higher contents, for example, between 5 and 30% by weight, preferably between 7.5 and 25% by weight, and in particular between 10 and 20% by weight. The skilled worker is not restricted in his or her freedom to formulate and may in this way produce more strongly or more weakly bleaching laundry detergent, cleaning product or bleach tablets by varying the amounts of bleach activator and bleach.

One particularly preferred bleach activator used is N,N,N',N'-tetraacetylethylenediamine, which is widely used in laundry detergents and cleaning products. Accordingly, in preferred laundry detergent and cleaning product tablets, tetraacetylethylenediamine in the abovementioned amounts is used as bleach activator.

In addition to the abovementioned constituents—bleach, bleach activator, builder, surfactant, and disintegration aid—the laundry detergent and cleaning product tablets of the invention may comprise further customary laundry detergent and cleaning product ingredients from the group consisting of dyes, fragrances, optical brighteners, enzymes, foam inhibitors, silicone oils, antiredeposition agents, graying inhibitors, color transfer inhibitors, and corrosion inhibitors.

In order to enhance the esthetic appeal of the laundry detergent and cleaning product tablets of the invention, they may be colored with appropriate dyes. Preferred dyes, whose selection presents no difficulty whatsoever to the skilled worker, possess a high level of storage stability and insensitivity to the other ingredients of the compositions and to light and possess no pronounced substantinity for textile fibers, so as not to stain them.

Preference for use in the laundry detergent and cleaning product tablets of the invention is given to all colorants which can be oxidatively destroyed in the wash process, and to mixtures thereof with suitable blue dyes, known as bluing agents. It has proven advantageous to use colorants which are soluble in water or at room temperature in liquid organic substances. Examples of suitable colorants are anionic colorants, e.g., anionic nitroso dyes. One possible colorant is, for example, naphthol green (Colour Index (CI) Part 1: Acid Green 1; Part 2: 10020) which as a commercial product is obtainable, for example, as Basacid® Green 970 from BASF, Ludwigshafen, and also mixtures thereof with suitable blue dyes. Further suitable colorants include Pigmosol® Blue 6900 (CI 74160), Pigmosol® Green 8730 (CI 74260), Basonyl® Red 545 FL (CI 45170), Sandolan® Rhodamin EB400 (CI 45100), Basacid® Yellow 094 (CI 47005), Sicovit® Patent Blue 85 E 131 (CI 42051), Acid Blue 183 (CAS 12217-22-0, CI Acid Blue 183), Pigment Blue 15 (CI 74160), Supranol® Blue GLW (CAS 12219-32-8, CI Acid Blue 221), Nylosan® Yellow N-7GL SGR (CAS 61814-57-1, CI Acid Yellow 218) and/or Sandolan® Blue (CI Acid Blue 182, CAS 12219-26-0).

In the context of the choice of colorant it must be ensured that the colorants do not have too great an affinity for the textile surfaces, and especially for synthetic fibers. At the same time, it should also be borne in mind in choosing appropriate colorants that colorants possess different stabilities with respect to oxidation. The general rule is that water-insoluble colorants are more stable to oxidation than water-soluble colorants. Depending on the solubility and hence also on the oxidation sensitivity, the concentration of the colorant in the laundry detergents and cleaning products varies. With readily water-soluble colorants, e.g., the abovementioned Basacid® Green, or the likewise abovementioned Sandolan® Blue, colorant concentrations chosen are typically in the range from a few $10^{-2}$ to $10^{-3}$% by weight. In the case of the pigment dyes, which are particularly preferred for reason of their brightness but are less readily soluble in water, examples being the abovementioned Pigmosol® dyes, the appropriate concentration of the colorant in laundry detergents or cleaning products, in contrast, is typically from a few $10^{-3}$ to $10^{-4}$% by weight.

The colorants may comprise optical brighteners of the type of the derivatives of diaminostilbenedisulfonic acid and the alkali metal salts thereof. Examples of suitable brighteners are salts of 4,4'-bis(2-anilino-4-morpholino-1,3,5-triazinyl-6-amino)stilbene-2, 2'-disulfonic acid or compounds of similar structure which instead of the morphilino group carry a diethanolamino group, a methylamino group, an anilino group, or a 2-methoxyethylamino group. Furthermore, brighteners of the substituted diphenylstyryl type may be present, examples being the alkali metal salts of 4,4'-bis(2-sulfostyryl)biphenyl, 4,4'-bis(4-chloro-3-sulfostyryl)-biphenyl, or 4-(4-chlorostyryl)-4'-(2-sulfostyryl)-biphenyl. Mixtures of the abovementioned brighteners may also be used. In the laundry detergent and cleaning product tablets, the optical brighteners are used in concentrations of between 0.01 and 1% by weight, preferably between 0.05 and 0.5% by weight, and in particular between 0.1 and 0.25% by weight, based in each case on the total tablet.

Fragrances are added in order to enhance the esthetic appeal of the products and to provide the consumer with not only product performance but also a visually and sensorially "typical and unmistakeable" product. As perfume oils and/or fragrances it is possible to use individual odorant compounds, examples being the synthetic products of the ester, ether, aldehyde, ketone, alcohol, and hydrocarbon types. Odorant compounds of the ester type are, for example, benzyl acetate, phenoxyethyl isobutyrate, p-tert-butylcyclohexyl acetate, linalyl acetate, dimethyl-benzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8–18 carbon atoms, citral, citronellal, citronellyloxyacetaldehyde, cyclamen aldehyde, hydroxycitronellal, lilial and bourgeonal; the ketones include, for example, the ionones, α-isomethylionone and methyl cedryl ketone; the alcohols include anethole, citronellol, eugenol, geraniol, linalool, phenylethyl alcohol, and terpineol; the hydrocarbons include primarily the terpenes such as limonene and pinene. Preference, however, is given to the use of mixtures of different odorants, which together produce an appealing fragrance note. Such perfume oils may also contain natural odorant mixtures, as obtainable from plant sources, examples being pine oil, citrus oil, jasmine oil, patchouli oil, rose oil or ylang-ylang oil. Likewise suitable are muscatel sage oil, camomile oil, clove oil, balm oil, mint oil, cinnamon leaf oil, lime blossom oil, juniperberry oil, vetiver oil, olibanum oil, galbanum oil and labdanum oil, and also orange blossom oil, neroliol, orange peel oil, and sandalwood oil.

The fragrance content of the laundry detergent and cleaning product tablets is usually up to 2% by weight of the overall formulation. The fragrances may be incorporated directly into the compositions; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be additionally coated with further auxiliaries.

Suitable enzymes include in particular those from the classes of the hydrolases such as the proteases, esterases, lipases or lipolytic enzymes, amylases, cellulases or other glycosyl hydrolases, and mixtures of said enzymes. In laundering, all of these hydrolases contribute to removing stains, such as proteinaceous, fatty or starchy marks and graying. Cellulases and other glycosyl hydrolases may, furthermore, contribute, by removing pilling and microfibrils, to the retention of color and to an increase in the softness of the textile. For bleaching, and/or for inhibiting color transfer it is also possible to use oxidoreductases. Especially suitable enzymatic active substances are those obtained from bacterial strains or fungi such as *Bacillus subtilis, Bacillus licheniformis, Streptomyceus griseus, Coprinus cinereus* and *Humicola insolens*, and also from genetically modified variants thereof. Preference is given to the use of proteases of the subtilisin type, and especially to proteases obtained from *Bacillus lentus*. Of particular interest in this context are enzyme mixtures, examples being those of protease and amylase or protease and lipase or lipolytic enzymes, or protease and cellulase or of cellulase and lipase or lipolytic enzymes or of protease, amylase and lipase or lipolytic enzymes, or protease, lipase or lipolytic enzymes and cellulase, but especially protease and/or lipase-containing mixtures or mixtures with lipolytic enzymes. Examples of such lipolytic enzymes are the known cutinases. Peroxidases or oxidases have also proven suitable in some cases. The suitable amylases include, in particular, alpha-amylases, iso-amylases, pullulanases, and pectinases. Cellulases used are preferably cellobiohydrolases, endoglucanases and endoglucosidases, which are also called cellobiases, and mixtures thereof. Because different types of cellulase differ in their CMCase and Avicelase activities, specific mixtures of the cellulases may be used to establish the desired activities.

The enzymes may be adsorbed on carrier substances or embedded in coating substances in order to protect them against premature decomposition. The proportion of the enzymes, enzyme mixtures or enzyme granules may be, for example, from about 0.1 to 5% by weight, preferably from 0.5 to about 4.5% by weight.

In addition, the laundry detergent and cleaning product tablets may also comprise components which have a positive influence on the ease with which oil and grease are washed off from textiles (these components being known as soil repellents). This effect becomes particularly marked when a textile is soiled that has already been laundered previously a number of times with a detergent of the invention comprising this oil- and fat-dissolving component. The preferred oil- and fat-dissolving components include, for example, nonionic cellulose ethers such as methylcellulose and methylhydroxypropylcellulose having a methoxy group content of from 15 to 30% by weight and a hydroxypropyl group content of from 1 to 15% by weight, based in each case on the nonionic cellulose ether, and also the prior art polymers of phthalic acid and/or terephthalic acid, and/or derivatives thereof, especially polymers of ethylene terephthalates and/or polyethylene glycol terephthalates or anionically and/or nonionically modified derivatives thereof. Of these, particular preference is given to the sulfonated derivatives of phthalic acid polymers and of terephthalic acid polymers.

The tablets to be coated can be produced by customary compressive and noncompressive methods. These methods are described below. It is also possible to produce only parts of the tablets and to join the parts, obtained from different processes, together in a later step. The expression "tablet" used herein of course includes tablet parts as well.

The tablets produced by compressive processes are produced in two steps. In the first step, laundry detergent and cleaning product tablets are produced in a conventional manner by compressing particulate laundry detergent and cleaning product compositions, and in the second step are provided with the coating.

There follows a description of the two essential process steps.

The tablets later to be coated in accordance with the invention are produced first of all by dry-mixing the constituents, some or all of which may have been pregranulated, and subsequently shaping the dry mixture, in particular by compression to tablets, in which context it is possible to have recourse to conventional processes. To produce the tablets, the premix is compacted in a so-called die between two punches to form a solid compact. This operation, which is referred to below for short as tableting, is divided into four sections: metering, compaction (elastic deformation), plastic deformation, and ejection.

First of all, the premix is introduced into the die, the fill level and thus the weight and form of the resulting tablet being determined by the position of the lower punch and by the form of the compression tool. Even in the case of high tablet throughputs, constant metering is preferably achieved by volumetric metering of the premix. In the subsequent course of tableting, the upper punch contacts the premix and is lowered further in the direction of the lower punch. In the course of this compaction the particles of the premix are pressed closer to one another, with a continual reduction in the void volume within the filling between the punches. When the upper punch reaches a certain position (and thus when a certain pressure is acting on the premix), plastic deformation begins, in which the particles coalesce and the tablet is formed. Depending on the physical properties of the premix, a portion of the premix particles is also crushed and at even higher pressures there is sintering of the premix. With an increasing compression rate, i.e., high throughputs, the phase of elastic deformation becomes shorter and shorter, with the result that the tablets formed may have larger or smaller voids. In the final step of tableting, the finished tablet is ejected from the die by the lower punch and conveyed away by means of downstream transport means. At this point in time, it is only the weight of the tablet which has been ultimately defined, since the compacts may still change their form and size as a result of physical processes (elastic relaxation, crystallographic effects, cooling, etc).

Tableting takes place in commercially customary tableting presses, which may in principle be equipped with single or double punches. In the latter case, pressure is built up not only using the upper punch; the lower punch as well moves toward the upper punch during the compression operation, while the upper punch presses downward. For small production volumes it is preferred to use eccentric tableting presses, in which the punch or punches is or are attached to an eccentric disk, which in turn is mounted on an axle having a defined speed of rotation. The movement of these compression punches is comparable with the way in which a customary four-stroke engine works. Compression can take place with one upper and one lower punch, or else a plurality of punches may be attached to one eccentric disk, the number of die bores being increased correspondingly. The throughputs of eccentric presses vary, depending on model, from several hundred up to a maximum of 3000 tablets per hour.

For greater throughputs, the apparatus chosen comprises rotary tableting presses, in which a relatively large number of dies is arranged in a circle on a so-called die table. Depending on the model, the number of dies varies between 6 and 55, larger dies also being obtainable commercially. Each die on the die table is allocated an upper punch and a lower punch, it being possible again for the compressive pressure to be built up actively by the upper punch or lower punch only or else by both punches. The die table and the punches move around a common, vertical axis, and during rotation the punches, by means of raillike cam tracks, are brought into the positions for filling, compaction, plastic deformation, and ejection. At those sites where considerable raising or lowering of the punches is necessary (filling, compaction, ejection), these cam tracks are assisted by additional low-pressure sections, low tension rails, and discharge tracks. The die is filled by way of a rigid supply means, known as the filling shoe, which is connected to a stock vessel for the premix. The compressive pressure on the premix can be adjusted individually for upper punch and lower punch by way of the compression paths, the buildup of pressure taking place by the rolling movement of the punch shaft heads past displaceable pressure rolls.

In order to increase the throughput, rotary presses may also be provided with two filling shoes, in which case only one half-circle need be traveled to produce one tablet. For the production of two-layer and multilayer tablets, a plurality of filling shoes are arranged in series, and the gently pressed first layer is not ejected before further filling. By means of an appropriate process regime it is possible in this way to produce laminated tablets and inlay tablets as well, having a construction like that of an onion skin, where in the case of the inlay tablets the top face of the core or of the core layers is not covered and therefore remains visible. Rotary tableting presses can also be equipped with single or multiple tools, so that, for example, an outer circle with 50 bores and an inner circle with 35 bores can be used simultaneously for compresssion. The throughputs of modern rotary tableting presses amount to more than a million tablets per hour.

When tableting with rotary presses it has been found advantageous to perform tableting with minimal fluctuations in tablet weight. Fluctuations in tablet hardness can also be reduced in this way. Slight variations in weight can be achieved as follows:

- use of plastic inserts with small thickness tolerances
- low rotor speed
- large filling shoes
- harmonization between the filling shoe wing rotary speed and the speed of the rotor
- filling shoe with constant powder level
- decoupling of filling shoe and powder charge To reduce caking on the punches, all of the antiadhesion coatings known from the art are available. Polymer coatings, plastic inserts or plastic punches are particularly advantageous. Rotating punches have also been found advantageous, in which case, where possible, upper punch and lower punch should be of rotatable configuration. In the case of rotating punches, it is generally possible to do without a plastic insert. In this case the punch surfaces should be electropolished.

It has also been found that long compression times are advantageous. These times can be established using pressure rails, a plurality of pressure rolls, or low rotor speeds. Since the fluctuations in tablet hardness are caused by the fluctuations in the compressive forces, systems should be employed which limit the compressive force. In this case it is possible to use elastic punches, pneumatic compensators, or sprung elements in the force path. In addition, the pressure roll may be of sprung design.

Tableting machines suitable in the context of the present invention are obtainable, for example, from the following companies: Apparatebau Holzwarth GbR, Asperg, Wilhelm Fette GmbH, Schwarzenbek, Hofer GmbH, Weil, Horn & Noack Pharmatechnik GmbH, Worms, IMA Verpackungssysteme GmbH, Viersen, KILIAN, Cologne, KOMAGE, Kell am See, KORSCH Pressen AG, Berlin, and Romaco GmbH, Worms. Examples of further suppliers are Dr. Herbert Pete, Vienna (AU), Mapag Maschinenbau AG, Berne (CH), BWI Manesty, Liverpool (GB), I. Holland Ltd., Nottingham (GB), Courtoy N.V., Halle (BE/LU), and Medicopharm, Kamnik (SI). A particularly suitable apparatus is, for example, the hydraulic double-pressure press HPF 630 from LAEIS, D. Tableting tools are obtainable, for example, from the following companies: Adams Tablettierwerkzeuge, Dresden, Wilhelm Fett GmbH, Schwarzenbek, Klaus Hammer, Solingen, Herber & Söhne GmbH, Hamburg, Hofer GmbH, Weil, Horn & Noack, Pharmatechnik GmbH, Worms, Ritter Pharmatechnik GmbH, Hamburg, Romaco GmbH, Worms, and Notter Werkzeugbau, Tamm. Further suppliers are, for example, Senss AG, Reinach (CH) and Medicopharm, Kamnik (SI).

The tablets can be produced in predetermined three-dimensional forms and predetermined sizes. Suitable three-dimensional forms are virtually any practicable designs—i.e., for example, bar, rod or ingot form, cubes, blocks and corresponding three-dimensional elements having planar side faces, and in particular cylindrical designs with a circular or oval cross section. This latter design covers forms ranging from tablets through to compact cylinders having a height-to-diameter ratio of more than 1.

The portioned compacts may in each case be formed as separate, individual elements corresponding to the predetermined dosage of the laundry detergents and/or cleaning products. It is equally possible, however, to design compacts that combine a plurality of such mass units in one compact, with the ease of separation of smaller, portioned units being provided for in particular by means of predetermined breakage points. For the use of textile laundry detergents in machines of the type customary in Europe, with a horizontally arranged mechanism, it may be judicious to design the portioned compacts as tablets, in cylindrical or block form, preference being given to a diameter/height ratio in the range from about 0.5:2 to 2:0.5. Commercial hydraulic, eccentric or rotary presses are suitable devices in particular for producing such compacts.

Particularly preferred preparation variants for uncompressed tablet parts are sintering, casting, the hardening of shapeable masses, and the preparation of particles, e.g., by granulation, pelleting, extrusion, agglomeration etc.

Sintering represents here the provision of an optionally preformed particle pile which, under the action of external conditions (temperature, radiation, reactive gases, liquids etc.), is converted into a compact tablet part. Examples of sintering processes are the preparation, known from the prior art, of tablets by microwaves or radiation hardening.

A further preferred sintering process for the preparation of uncompressed tablet parts is reactive sintering. Here, the starting components are shaped and then solidified by reacting a component A and a component B together, the components A and B being mixed with the starting components, being applied thereto or being added after shaping.

As this process is being carried out, the components A and B react, with solidification of the individual ingredients with one another. The reaction product formed from the components A and B combines the individual starting components such that a solid, relatively fracture-stable tablet is obtained.

Using this process, tablets with good disintegration are obtained. Since the binding of the individual ingredients takes place by reactive sintering and is not brought about by the "stickiness" of the granulates of the premix, it is not necessary to adapt the formulation to the binding properties of the individual ingredients. These can be adapted as desired depending on their effectiveness.

In order to react the components A and B with one another, it has proven advantageous if the starting components are mixed with component A or are coated therewith before being shaped. Examples of compounds of component A are the alkali metal hydroxides, in particular NaOH and KOH, alkaline earth metal hydroxides, in particular $Ca(OH)_2$, alkali metal silicates, organic or inorganic acids, such as citric acid, or acidic salts, such as hydrogensulfate, anhydrous hydratable salts or salts containing water of hydration, such as sodium carbonate, acetates, sulfates, alkali metal metallates, it also being possible to use the compounds mentioned above, wherever possible, in the form of their aqueous solutions.

Component B is chosen such that it reacts with component A without exercising relatively high pressures or significantly increasing the temperature to form a solid, with solidification of the other starting components present. Examples of compounds of component B are $CO_2$, $NH_3$, water vapor or spray mist, salts containing water of hydration, which may react with the anhydrous salts present as component A as the result of hydrate migration, anhydrous salts which form hydrates which react with the salts of component A which contain water of hydration with hydrate migration, $SO_2$, $SO_3$, HCl, HBr, silicon halides, such as $SiCl_4$ or silicates $S(OR)_xR'_{4-x}$.

The abovementioned components A and B are interchangeable, provided two components are used which react together under sintering.

In a preferred embodiment of this preparation method, the starting components are mixed or coated with compounds of component A, and then the compounds of component B are added. It has proven particularly suitable if the compounds of component B are gaseous. The shaped starting components (referred to below as preforms) can then either be gassed in simple form or introduced into a gas atmosphere. A particularly preferred combination of components A and B are concentrated solutions of the alkali metal hydroxides, in particular NaOH and KOH, and alkaline earth metal hydroxides, such as $Ca(OH)_2$, or alkali metal silicates as component A, and $CO_2$ as component B.

To carry out the process according to the invention, the starting components are firstly shaped, i.e., they are usually poured into a die which has the outer shape of the tablet to be produced. The starting components are preferably in pulverulent to granular form. They are firstly mixed or coated with component A. After being introduced into the die or tablet mold, it has proven preferable to slightly press down on the starting components in the die, e.g., by hand or using a stamp at a pressure below the abovementioned values, in particular below 100 $N/cm^2$. It is also possible to compact the premix by vibration (tapping compaction).

They are then, if component A is not already present in the mixture with the starting components, coated therewith, and component B is added. When the reaction is over, a fracture-stable tablet is obtained without the action of pressure or temperature.

If one of the components A or B is a gas, then this can, for example, be added to a preform, such that the gas flows through it. This procedure permits a uniform hardening of the tablets within a short time.

In a further process variant, a preform is introduced into an atmosphere of the reactive gas. This variant is easy to carry out. It is possible to prepare tablets which have a high degree of hardness, i.e., tablets which have only a hardened surface to tablets which are completely hardened through.

A preform or the premix can also be reacted with the reactive gas under a pressure above atmospheric. This process variant has the advantage that the surface hardens rapidly to form a hard shell, the hardening process being stopped here or, as described above, completely hardened-through tablets can also be produced by increasing hardening stages.

The above process variants can also be combined by firstly passing reactive gas through the preform in order to expel air. The preform is then exposed to a gas atmosphere at atmospheric pressure. As a result of the reaction between the gas and the second component, gas is automatically sucked into the preform.

In one possible embodiment of the present invention, it is not the starting mixture which is coated with the component A, but a preshaped preform, which is then reacted with the component B. It hardens the layer on the surface of the preform, while the loose or slightly compacted structure in the core is retained. Such tablets are notable for particularly good disintegration behavior.

Uncompressed tablets can also be prepared by casting. This can be influenced either through the choice of the starting materials, or can be achieved by suspending the desired ingredients in a meltable matrix.

The solidification of solutions which are at ambient temperature is also a method of producing uncompressed parts. Aqueous solutions can be thickened according to processes known in the prior art up to firm-consistency tablet regions by adding thickeners. Examples of such thickeners which form solid gelatinous masses are alginates, pectins, gelatins etc.

Polymeric thickeners are preferably suitable for the preparation of gelatinous, shape-stable uncompressed tablets from aqueous or nonaqueous solutions. These organic, high molecular mass substances, also called swell(ing) agents, which absorb liquids, swell up as a result and finally convert to high-viscosity true or colloidal solutions, originate from the groups of natural polymers, modified natural polymers, and completely synthetic polymers.

Polymers originating from nature which can be used as thickeners are, for example, agar agar, carrageen, tragacanth, gum arabic, alginates, pectins, polyoses, guar flour, carob seed grain flour, starch, dextrins, gelatin and casein. Modified natural substances originate primarily from the group of modified starches and celluloses, examples which may be mentioned here being carboxymethylcellulose and other cellulose ethers, hydroxyethyl-cellulose and hydroxypropyl-cellulose, and seed grain ethers.

A large group of thickeners which are used widely in a very wide variety of fields of use are the completely synthetic polymers, such as polyacrylic and polymethacrylic compounds, vinyl polymers, polycarboxylic acids, polyethers, polyimines, polyamides, and polyurethanes.

Thickeners from said classes of substance are widely available commercially and are obtainable, for example, under the trade names Acusol®-820 (methacrylic (stearyl alcohol 20-EO)ester/acrylic acid copolymer, 30% strength in water, Rohm & Haas), Dapral®-GT-282-S (alkyl polyglycol ether, Akzo), Deuterol®-Polymer-11 (dicarboxylic acid copolymer, Schoner GmbH), Deuteron®-XG (anionic heteropolysaccharide based on β-D-glucose, D-mannose, D-glucuronic acid, Schöner GmbH), Deuteron®-XN (nonionogenic polysaccharide, Schöner GmbH), Dicrylan®-Verdicker [thickener]-O (ethylene oxide adduct, 50% strength in water/isopropanol, Pfersee Chemie), EMA®-81 and EMA®-91 (ethylene/maleic anhydride copolymer, Monsanto), Verdicker [thickener]-QR-1001 (Polyurethane Emulsion 19–21% strength in water/diglycol ether, Rohm & Haas), Mirox®-AM (anionic acrylic acid/acrylic ester copolymer dispersion, 25% strength in water, Stockhausen), SER-AD-FX-1100 (hydrophobic urethane polymer, Servo Delden), Shellflo®-S (high molecular weight polysaccharide, stabilized with formaldehyde, Shell), and Shellflo®-XA (xanthan biopolymer, stabilized with formaldehyde, Shell).

Preferred uncompressed parts comprise, as thickeners, 0.2 to 4% by weight, preferably 0.3 to 3% by weight, and in particular 0.4 to 1.5% by weight, of a polysaccharide.

A preferredly used polymeric thickener is xanthan, a microbial anionic heteropolysaccharide which is produced by Xanthomonas campestris and a few other species under aerobic conditions and have a molar mass of from 2 to 15 million daltons. Xanthan is formed from a chain having β-1,4-bonded glucose (cellulose) with side chains. The structure of the subgroups consists of glucose, mannose, glucuronic acid, acetate and pyruvate, the number of pyruvate units determining the viscosity of the xanthan.

Xanthan can be described by the following formula:

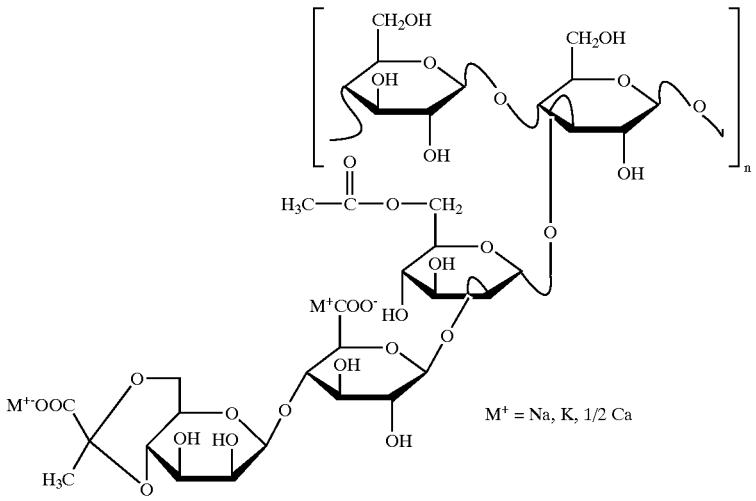

Basic unit of xanthan

-continued

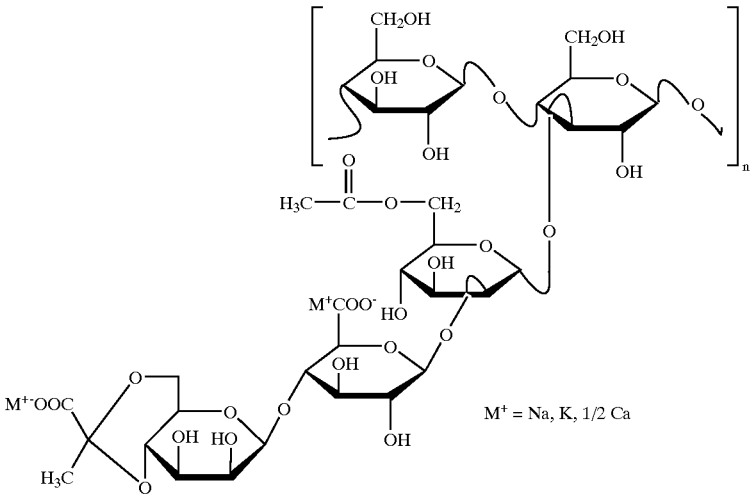

Basic unit of xanthan

Where xanthan is used as thickener the uncompressed tablets can contain tablet based in each case the total from 0.2 to 4% by weight, preferably 0.3 to 3% by weight, and in particular 0.4 to 1.5% by weight, of xanthan.

Further suitable thickeners are polyurethanes or modified polyacrylates which are usually used, based on the total uncompressed portion, in amounts of from 0.2 to 5% by weight.

Polyurethanes (PURs) are prepared by polyaddition from di- and polyhydric alcohols and isocyanates and can be described by the general formula XII

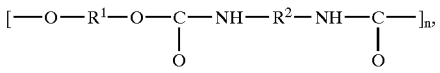

(XII)

in which $R^1$ is a low molecular mass or polymeric diol radical, $R^2$ is an aliphatic or aromatic group, and n is a natural number. $R^1$ is preferably a linear or branched $C_{2-12}$ alk(en)yl group, but can also be a radical of a polyhydric alcohol, as a result of which crosslinked polyurethanes are formed which differ from the formula III given above by virtue of the fact that further —O—CO—NH groups are bonded to the radical $R^1$.

Industrially important PURs are prepared from polyesterdiols and/or polyetherdiols and, for example, from 2,4- or 2,6-toluene diisocyanate (TDI, $R^2{=}C_6H_3{-}CH_3$), 4,4'-methylenedi(phenyl isocyanate) (MDI, $R^2{=}C_6H_4{-}CH_2{-}C_6H_4$) or hexamethylene diisocyanate [HMDI, $R^2{=}(CH_2)_6$].

Commercially available thickeners based on polyurethane are obtainable, for example, under the names Acrysol®PM 12 V (mixture of 3–5% modified starch and 14–16% PU resin in water, Rohm & Haas), Borchigel® L75-N (nonionogenic PU dispersion, 50% strength in water, Borchers), Coatex® BR-100-P (PU dispersion, 50% strength in water/butyl glycol, Dimed), Nopco® DSX-1514 (PU dispersion, 40% strength in water/butyl triglycol, Henkel-Nopco), Verdicker [thickener] QR 1001 (20% strength PUR emulsion in water/diglycol ether, Rohm & Haas) and Rilanit® VPW-3116 (PU dispersion, 43% strength in water, Henkel).

Preferred uncompressed parts (a) comprise 0.2 to 4% by weight, preferably 0.3 to 3% by weight and in particular 0.5 to 1.5% by weight, of a polyurethane.

Modified polyacrylates which can be used for the purposes of the present invention are derived, for example, from acrylic acid or from methacrylic acid and can be described by the general formula XIII

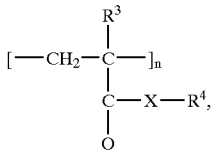

(XIII)

in which $R^3$ is H or a branched or unbranched $C_{1-4}$ alk(en)yl radical, X is N—$R^5$ or O, $R^4$ is an optionally alkoxylated branched or unbranched, optionally substituted $C_{8-22}$ alk(en)yl radical, $R^5$ is H or $R^4$ and n is a natural number. In general, such modified polyacrylates are esters or amides of acrylic acid or of an α-substituted acrylic acid. Of these polymers, preference is given to those in which $R^3$ is H or a methyl group. In the case of the polyacrylamides (X=N—$R^5$), both mono-N-substituted ($R^5$=H) and also di-N-substituted ($R^5{=}R^4$) amide structures are possible, it being possible to choose the two hydrocarbon radicals which are bonded to the N atom independently of one another from optionally alkoxylated branched or unbranched $C_{8-22}$ alk(en)yl radicals. Of the polyacrylic esters (X=O), preference is given to those in which the alcohol has been obtained from natural or synthetic fats or oils and has additionally been alkoxylated, preferably ethoxylated. Preferred degrees of alkoxylation are between 2 and 30, particular preference being given to degrees of alkoxylation between 10 and 15.

Since the polymers which can be used are technical-grade compounds, the designation of the radicals bonded to X is a statistical average which can vary in individual cases with regard to chain length and degree of alkoxylation. Formula II merely indicates formulae for idealized homopolymers. However, for the purposes of the present invention, it is also possible to use copolymers in which the portion of monomer units which satisfy the formula II is at least 30% by weight.

Thus, for example, it is also possible to use copolymers of modified polyacrylates and acrylic acid or salts thereof which still have acidic H atoms or basic —$COO^-$ groups.

Modified polyacrylates which are preferred for use for the purposes of the present invention are polyacrylate/ polymethacrylate copolymers which satisfy the formula XIIIa

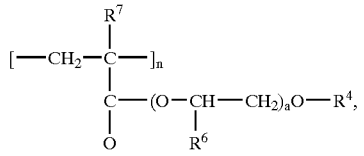

(XIIIa)

in which $R^4$ is a preferably unbranched, saturated or unsaturated $C_{8-22}$ alk(en)yl radical, $R^6$ and $R^7$ independently of one another are H or $CH_3$, the degree of polymerization n is a natural number, and the degree of alkoxylation a is a natural number between 2 and 30, preferably between 10 and 20. $R^4$ is preferably a fatty alcohol radical which has been obtained from natural or synthetic sources, the fatty alcohol in turn preferably being ethoxylated ($R^6$=H).

Products of the formula XIIIa are commercially available, for example, under the name Acusol® 820 (Rohm & Haas) in the form of 30% strength by weight dispersions in water. In the case of said commercial product, $R^4$ is a stearyl radical, $R^6$ is a hydrogen atom, $R^7$ is H or $CH_3$, and the degree of ethoxylation a is 20.

Modified polyacrylate of the formula IV can be present in an amount, based in each case on the total tablet, of from 0.2 to 4% by weight, preferably 0.3 to 3% by weight, and in particular 0.5 to 1.5% by weight.

An uncompressed tablet can also be produced by hardening reshapeable masses which have been converted to the desired shape beforehand by shaping processes.

The hardening of the shapeable mass(es) can be carried out by a variety of mechanisms, with delayed water binding, cooling below the melting point, evaporation of solvents, crystallization, by chemical reaction(s), in particular polymerization, and changing of the Theological properties for example as a result of a changed shearing of the mass(es) being statable as the most important hardening mechanisms in addition to the already mentioned radiation hardening by UV, alpha, beta or gamma rays or microwaves.

In this preferred embodiment, a shapeable, preferably plastic, mass is prepared which can be shaped without considerable pressures. Following the shaping, the hardening is then carried out by suitable initiation or by waiting for a certain period. If masses which have self-hardening properties without further initiation are processed, then this is to be taken into consideration during processing in order to avoid instances of complete hardening during shaping and, consequently, blockages and disruptions to the process sequences.

In one possible embodiment, production takes place by means of time-delayed water binding.

Time-delayed water binding in the masses can in turn be realized in different ways. Appropriate here are, for example, masses which comprise hydratable, anhydrous raw materials or raw materials in low states of hydration which are able to undergo transition to stable higher hydrates, and also water. The formation of the hydrates, which does not take place spontaneously, then leads to the binding of free water, which in turn leads to a hardening of the masses. Low-pressure shaping is subsequently no longer possible, and the tablets formed are stable to handling and may be treated further and/or packaged.

The time-offset water binding may, for example, also take place by incorporating salts containing water of hydration, which when the temperature is increased dissolve in their own water of crystallization, into the masses. If the temperature subsequently drops, then the water of crystallization is bound again, leading to a loss of shapeability by simple means and to a solidification of the masses.

The swelling of natural or synthetic polymers is also a time-delayed water-binding mechanism which can be used for the purposes of the process according to the invention. Here, mixtures of unswollen polymer and suitable swelling agent, e.g., water, diols, glycerol etc., can be incorporated into the masses, with swelling and hardening taking place after shaping.

The most important mechanism of hardening by time-delayed water binding is the use of a combination of water and anhydrous or low-water raw materials which slowly hydrate. Particularly appropriate for this purpose are substances which contribute to the washing performance in the washing or cleaning process. Ingredients of the shapeable masses preferred for the purposes of the present invention are, for example, phosphates, carbonates, silicates, and zeolites.

It is particularly preferred if the resulting hydrate forms have low melting points, since in this way a combination of the hardening mechanisms by internal drying and cooling is achieved. Preferred processes are characterized in that the shapeable mass(es) comprise(s) 10 to 95% by weight, preferably 15 to 90% by weight, particularly preferably 20 to 85% by weight and in particular 25 to 80% by weight, of anhydrous substances which convert, as a result of hydration, to a hydrate form having a melting point below 120° C., preferably below 100° C. and in particular below 80° C.

The shapeable properties of the masses may be influenced by adding plastifying auxiliaries, such as polyethylene glycols, polypropylene glycols, waxes, paraffins, nonionic surfactants, etc.

A further mechanism for hardening the masses processed in the process according to the invention is cooling during the processing of the masses above their softening point.

Masses which can be softened under the effect of temperature can be formulated easily by mixing the desired further ingredients with a meltable or softenable substance, and heating the mixture to temperatures within the softening range of this substance and shaping the mixture at these temperatures. Particular preference is given here to using waxes, paraffins, polyalkylene glycols etc. as meltable or softenable substances. These are described below.

The meltable or softenable substances should have a melting range (solidification range) within a temperature range in which the other ingredients of the masses to be processed are not subjected to excessive thermal stress. On the other hand, however, the melting range must be sufficiently high still to provide a handlable tablet at at least slightly elevated temperature. In masses preferred according to the invention, the meltable or softenable substances have a melting point above 30° C.

It has proven advantageous if the meltable or softenable substances do not exhibit a sharply defined melting point, as usually occurs in the case of pure, crystalline substances, but instead have a melting range which covers, under certain circumstances, several degrees Celsius. The meltable or softenable substances preferably have a melting range between about 45° C. and about 75° C. In the present case, this means that the melting range is within the given temperature interval, and does not define the width of the melting range. The width of the melting range is preferably at least 1° C., preferably about 2 to about 3° C.

The abovementioned properties are usually satisfied by what are termed waxes. "Waxes" is understood as meaning a series of natural or artificially obtained substances which generally melt above 40° C. without decomposition, and are of relatively low-viscosity and are non-stringing at just a little above the melting point. They have a highly temperature-dependent consistency and solubility.

According to their origin, the waxes are divided into three groups: natural waxes, chemically modified waxes, and synthetic waxes.

Natural waxes include, for example, plant waxes, such as candelilla wax, carnauba wax, Japan wax, esparto grass wax, cork wax, guaruma wax, rice germ oil wax, sugarcane wax, ouricury wax, or montan wax, animal waxes, such as beeswax, shellac wax, spermaceti, lanolin (wool wax), or uropygial grease, mineral waxes, such as ceresin or ozokerite (earth wax), or petrochemical waxes, such as petrolatum, paraffin waxes or microcrystalline waxes.

Chemically modified waxes include, for example, hard waxes, such as montan ester waxes, sassol waxes or hydrogenated jojoba waxes.

Synthetic waxes are generally understood as meaning polyalkylene waxes or polyalkylene glycol waxes. Meltable or softenable substances which can be used for the masses hardenable by cooling are also compounds from other classes of substance which satisfy said requirements with regard to the softening point. Synthetic compounds which have proven suitable are, for example, higher esters of phthalic acid, in particular dicyclohexyl phthalate, which is commercially available under the name Unimoll® 66 (Bayer AG). Also suitable are synthetically prepared waxes from lower carboxylic acids and fatty alcohols, for example dimyristyl tartrate, which is available under the name Cosmacol® ETLP (Condea). Conversely, synthetic or partially synthetic esters of lower alcohols with fatty acids from native sources may also be used. This class of substance includes, for example, Tegin® 90 (Goldschmidt), a glycerol monostearate palmitate. Shellac, for example Shellack-KPS-Dreiring-SP (Kalkhoff GmbH), can also be used according to the invention as meltable or softenable substances.

Also covered by waxes for the purposes of the present invention are, for example, so-called wax alcohols. Wax alcohols are relatively high molecular mass, water-insoluble fatty alcohols having generally about 22 to 40 carbon atoms. The wax alcohols occur, for example, in the form of wax esters of relatively high molecular weight fatty acids (wax acids) as the major constituent of many natural waxes. Examples of wax alcohols are lignoceryl alcohol (1-tetracosanol), cetyl alcohol, myristyl alcohol or melissyl alcohol. The coating of the coated solid particles can optionally also comprise wool wax alcohols, which is understood as meaning triterpenoid and steroid alcohols, for example lanolin, which is available, for example, under the trade name Argowax (Pamentier & Co). As a constituent of the meltable or softenable substances, it is also possible to use, at least proportionately, for the purposes of the present invention, fatty acid glyceryl esters or fatty acid alkanolamides, but also, if desired, water-insoluble or only sparingly water-soluble polyalkylene glycol compounds.

Particularly preferred meltable or softenable substances in the masses to be processed are those from the group of polyethylene glycols (PEG) and/or polypropylene glycols (PPG), preference being given to polyethylene glycols having molar masses between 1 500 and 36 000, particular preference being given to those having molar masses from 2 000 to 6 000 and special preference being given to those having molar masses from 3 000 to 5 000. Corresponding processes which are characterized in that the plastically shapeable mass(es) comprise(s) at least one substance from the group of polyethylene glycols (PEG) and/or polypropylene glycols (PPG) are also preferred. Here, particular preference is given to masses to be processed according to the invention which contain, as the sole meltable or softenable substances, propylene glycols (PPG) and/or polyethylene glycols (PEG). These substances have been described in detail above.

In a further preferred embodiment, the masses to be processed according to the invention comprise paraffin wax as the major fraction. This means that at least 50% by weight of the total meltable or softenable substances present, preferably more, consist of paraffin wax. Particularly suitable paraffin wax contents (based on the total amount of meltable or softenable substances) are about 60% by weight, about 70% by weight or about 80% by weight, particular preference being given to even higher proportions of, for example, more than 90% by weight. In a particular embodiment of the invention, the total amount of the meltable or softenable substances used, at least of one mass, consists exclusively of paraffin wax.

Compared with the other natural waxes mentioned, paraffin waxes have the advantage for the purposes of the present invention that in an alkaline cleaning product environment no hydrolysis of the waxes takes place (as is to be expected, for example, in the case of wax esters), since paraffin wax does not contain hydrolyzable groups.

Paraffin waxes consist primarily of alkanes, and low fractions of iso- and cycloalkanes. The paraffin to be used preferably essentially has no constituents having a melting point of more than 70° C., particularly preferably of more than 60° C. Below this melting temperature in the cleaning product liquor, fractions of high-melting alkanes in the paraffin may leave behind unwanted wax residues on the surfaces to be cleaned or on the ware to be cleaned. Such wax residues generally lead to an unattractive appearance of the cleaned surface and should therefore be avoided.

Preferred masses to be processed comprise, as meltable or softenable substances, at least one paraffin wax having a melting range from 50° C. to 60° C., preferred processes being characterized in that the shapeable mass(es) comprise (s) a paraffin wax having a melting range of from 50° C. to 55° C.

Preferably, the amount of alkanes, isoalkanes and cycloalkanes which are solid at ambient temperature (generally about 10 to about 30° C.) in the paraffin wax used is as high as possible. The larger the amount of solid wax constituents in a wax at room temperature, the more useful the wax for the purposes of the present invention. As the proportion of solid wax constituents increases, so does the resistance of the process end- products toward impacts or friction on other surfaces, resulting in relatively long-lasting protection. High proportions of oils or liquid wax constituents can lead to a weakening of the tablets or tablet regions, as a result of which pores are opened and the active substances are exposed to the ambient influences mentioned at the beginning.

As well as comprising paraffin as the main constituent, the meltable or softenable substances may also comprise one or more of the abovementioned waxes or waxlike substances. In a further preferred embodiment of the present invention, the mixture forming the meltable or softenable substances should be such that the mass and the tablets or tablet constituent formed therefrom are at least largely water-insoluble. At a temperature of about 30° C., the solubility in water should not exceed about 10 mg/l and should preferably be below 5 mg/l.

In such cases, however, the meltable or softenable substances should have the lowest possible solubility in water, even in water at elevated temperature, in order, as far as possible, to avoid temperature-independent release of the active substances.

The principle described above is used for the delayed release of ingredients at a particular point in time in a laundering and/or cleaning operation.

As meltable or softenable substances it is preferred to use those comprising one or more substances having a melting range of from 40° C. to 75° C. in amounts of from 6 to 30% by weight, preferably from 7.5 to 25% by weight, and in particular from 10 to 20% by weight, in each case based on the weight of the mass.

A further mechanism by which the hardening of the masses can take place is the evaporation of solvents. For this, it is possible to prepare solutions or dispersions of the desired ingredients in one or more suitable, readily volatile solvents which give off this/these solvent(s) after the shaping step and, in so doing, harden. Appropriate solvents are, for example, lower alkanols, aldehydes, ethers, esters etc, which are chosen depending on the further composition of the masses to be processed. Particularly suitable solvents for such processes in which the shapeable mass(es) harden(s) by evaporation of solvents are ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-l-propanol, 3-methyl-1-butanol; 3-methyl-2-butanol, 2-methyl-2-butanol, 2-methyl-l-butanol, 1-hexanol, and the acetic esters of the above alcohols, in particular ethyl acetate.

The evaporation of the abovementioned solvents may be accelerated by heating after shaping and sizing, or by air movement. Combinations of the measures specified are also suitable for this purpose, for example, the blowing of the cut-to-length tablets with warm or hot air.

A further mechanism which may form the basis for the hardening of the masses shaped to tablet parts is that of crystallization. Processes wherein the shapeable mass(es) harden(s) by crystallization are likewise preferred.

Crystallization, as a mechanism on which the hardening is based, may be utilized by using, for example, melts of crystalline substances as the basis of one or more shapeable masses. Following processing, systems of this kind undergo transition to a higher state of order, which in turn leads to hardening of the overall tablet formed. Alternatively, crystallization may take place by crystallization from supersaturated solution. In the context of the present invention, supersaturation refers to a metastable state in which, in a closed system, more of one substance is present than is required for saturation. A supersaturated solution obtained, for example, by supercooling accordingly comprises more dissolved substance than it should contain in thermal equilibrium. The excess of dissolved substance may be brought to instantaneous crystallization by seeding with seed crystals or dust particles or by agitating the system. In the context of the present invention, the term "supersaturated" always refers to a temperature of 20° C. If x grams of a substance per liter dissolve in a defined solvent at a temperature of 20° C., then the solution, in the context of the present invention, may be referred to as "supersaturated" if it contains (x+y) grams of the substance per liter, y being >0. Consequently, in the context of the present invention, solutions referred to as "supersaturated" include those which at an elevated temperature are used as the basis of a mass to be processed and are processed at this temperature, in which more dissolved substance is present in the solution than would dissolve in the same amount of solvent at 20° C.

The term "solubility" is understood by the present invention as meaning the maximum amount of a substance which the solvent is able to accommodate at a certain temperature, i.e., the fraction of the dissolved substance in a solution saturated at the temperature in question. Where a solution contains more dissolved substance than it should contain in thermodynamic equilibrium at a given temperature (for example, in the case of supercooling), it is referred to as supersaturated. By seeding with seed crystals it is possible to cause the excess to precipitate as a sediment in the solution, which is now just saturated. A solution saturated in respect of one substance may, however, also dissolve other substances (for example, it is still possible to dissolve sugar in a saturated solution of common salt).

The state of supersaturation can be achieved, as described above, by slow cooling or by supercooling a solution, provided the dissolved substance is more soluble in the solvent at higher temperatures. Other ways of obtaining supersaturated solutions are, for example, the combination of two solutions whose ingredients react to form another substance which does not immediately precipitate out (hindered or retarded precipitation reactions). The latter mechanism is particularly suitable as a basis for the formation of masses for processing.

In principle, the state of supersaturation is achievable in any kind of solution, although the use of the principle described in the present specification finds its application, as already mentioned, in the production of laundry detergents and cleaning products. Accordingly, some systems, which in principle tend to form supersaturated solutions, are less suitable for use in accordance with the invention, since the substance systems on which they are based cannot be used, on ecological, toxicological, or economic grounds. In addition to nonionic surfactants or common nonaqueous solvents, therefore, particular preference is given to processes with the last-mentioned hardening mechanism wherein a supersaturated aqueous solution is used as the basis of at least one mass to be processed.

As already mentioned above, the state of supersaturation in the context of the present invention refers to the saturated solution at 20° C. By using solutions which have a temperature above 20° C. it is easy to attain the state of supersaturation. Processes according to the invention wherein the crystallization-hardening mass during processing has a temperature of between 35 and 120° C., preferably between 40 and 110° C., particularly preferably between 45 and 90° C., and in particular between 50 and 80° C., are preferred in the context of the present invention.

Since the laundry detergent and cleaning product tablets produced are generally neither stored at elevated temperatures nor later used at these elevated temperatures, the cooling of the mixture leads to the precipitation from the supersaturated solution of the fraction of dissolved substance which remained in the solution above the saturation limit at 20° C. Thus, on cooling, the supersaturated solution may be divided into a saturated solution and a sediment. It is, however, also possible that, owing to recrystallization and hydration phenomena, the supersaturated solution solidifies on cooling to form a solid. This is the case, for example, if certain salts containing water of hydration dissolve in their water of crystallization on heating. In this case, supersaturated solutions are often formed on cooling which, by mechanical action or addition of seed crystal solidify to a solid—the salt, containing water of crystallization, as the state which is thermodynamically stable at room temperature. This phenomenon is known, for example, for sodium thiosulfate pentahydrate and sodium acetate trihydrate, the latter salt in particular, containing water of hydration, being advantageously useful in the form of the supersaturated solution in the process according to the invention. Specific laundry detergent and cleaning product ingredients as well, such as phosphonates, for example, display this phenomenon and are outstandingly suitable in the form of the solutions as granulation auxiliaries. For this purpose the corresponding phosphonic acids (see below) are neutralized with concentrated alkali metal hydroxide solutions, the solution being heated by the heat of neutralization. On cooling, these solutions form solids of the corresponding alkali metal phosphonates. By incorporating further laundry detergent and cleaning product ingredients into the solutions while still warm, it is possible in accordance with the invention to prepare processable masses of different composition. Particularly preferred processes are characterized in that the supersaturated solution used as a basis of the hardening mass solidifies at room temperature to form a solid. It is preferred in this case that the formerly supersaturated solution, following solidification to form a solid, cannot be converted back into a supersaturated solution by heating to the temperature at which the supersaturated solution was formed. This is the case, for example, with the phosphonates mentioned.

As mentioned above, the supersaturated solution used as a basis of the hardening mass may be obtained in a number of ways and then processed in accordance with the invention following optional admixing of further ingredients. One simple way, for example, is to prepare the supersaturated solution which is used as a basis of the hardening mass by dissolving the dissolved substance in heated solvent. If the amounts of the dissolved substance that are dissolved in this way in the heated solvent are higher than those which would dissolve at 20° C., then a solution is present which is supersaturated within the meaning of the present invention and which, either hot (see above) or after cooling, and in the metastable state, may be introduced into the mixer.

It is also possible to remove the water from salts containing water of hydration by "dry" heating and to dissolve them in their own water of crystallization (see above). This too is a method of preparing super-saturated solutions that may be used in the context of the present invention.

Another way is to add a gas or other fluid or solution to a non-supersaturated solution, so that the dissolved substance reacts in the solution to form a less soluble substance or dissolves to a lesser extent in the mixture of the solvents. The combination of two solutions each containing two substances which react with one another to form a less soluble substance is likewise a method of preparing supersaturated solutions, provided the less-soluble substance does not precipitate out instantaneously. Processes which are likewise preferred in the context of the present invention are characterized in that the supersaturated solution used as the basis of the hardening mass is prepared by combining two or more solutions. Examples of such ways of preparing supersaturated solutions are dealt with below.

Preferred processes are characterized in that the supersaturated aqueous solution is obtained by combining an aqueous solution of one or more acidic ingredients of laundry detergents and cleaning products, preferably from the group of the surfactant acids, the builder acids, and the complexing agent acids, and an aqueous alkali solution, preferably an aqueous alkali metal hydroxide solution, in particular an aqueous sodium hydroxide solution.

Among the representatives of said classes of compound that have already been mentioned above, the phosphonates in particular occupy an outstanding position in the context of the present invention. In preferred processes, therefore, the supersaturated aqueous solution is obtained by combining an aqueous phosphonic acid solution with concentrations above 45% by weight, preferably above 50% by weight, and in particular above 55% by weight, based in each case on the phosphonic acid solution, and an aqueous sodium hydroxide solution with concentrations above 35% by weight, preferably above 40% by weight, and in particular above 45% by weight, based in each case on the sodium hydroxide solution.

The hardening of the shapeable mass(es) may also take place by means of chemical reaction(s), in particular polymerization. Suitable in this context, in principle, are all chemical reactions which, starting from one or more liquid to pastelike substances, lead, by reaction with (an)other substance(s), to solids. Especially suitable in this context are chemical reactions which do not lead suddenly to said change of state. From the multitude of chemical reactions which lead to solidification phenomena, suitable reactions are in particular those in which larger molecules are built up from smaller molecules. These reactions include, in turn, preferably reactions in which many small molecules react to form (one) larger molecule(s). These reactions are known as polymerizations (addition polymerization, polyaddition, polycondensation) and polymer-analogous reactions. The corresponding addition polymers, polyadducts (polyaddition products) or polycondensates (polycondensation products) then give the finished, cut-to-length tablet its strength.

In view of the intended use of the products prepared in accordance with the invention it is preferred to utilize as hardening mechanism the formation of those solid substances from liquid or pastelike starting materials which are in any case to be used in the laundry detergent and cleaning product as ingredients, for example cobuilders, soil repellents, or soil release polymers. Such cobuilders may originate, for example, from the groups of the polycarboxylates/polycarboxylic acids, polymeric polycarboxylates, aspartic acid, polyacetals, dextrins, etc. These classes of substance are described below.

A further mechanism by which the shapeable mass(es) may harden in the context of the present invention is that of hardening as a result of a change in rheological properties.

In this case, use is made of the property possessed by certain substances of changing—in some instances, drastically—their rheological properties under the action of shear forces. Examples of such systems, which are familiar to the person skilled in the art, are phyllosilicates, for example, which under shearing have a highly thickening action in appropriate matrices and may lead to masses of firm consistency.

It is of course possible for two or more hardening mechanisms to be combined with one another and/or used simultaneously in one mass. Appropriate in this case, for example, are crystallization with simultaneous solvent evaporation, cooling with simultaneous crystallization, water binding ("internal drying") with simultaneous external drying, etc.

The three-dimensional form of another embodiment of the tablets is adapted in its dimensions to the dispener drawer of commercially customary household washing machines, so that the tablets can be metered without a dosing aid directly into the dispenser drawer, where they dissolve during the initial rinse cycle. Alternatively, it is of course readily possible, and preferred in the context of the present invention, to use the laundry detergent tablets by way of a dosing aid.

Another preferred tablet which can be produced has a platelike or barlike structure with, in alternation, long, thick and short, thin segments, so that individual segments can be broken off from this "slab" at the predetermined breaking points, represented by the short, thin segments, and inserted into the machine. This principle of the "slablike" tablet laundry detergent may also be realized in other geometric forms; for example, vertical triangles connected to one another lengthwise at only one of their sides.

However, it is also possible for the various components not to be compressed to a homogeneous tablet, but instead to obtain tablets having a plurality of layers, i.e., at least two layers. In this case it is also possible for these different layers to have different dissolution rates. This may result in advantageous performance properties for the tablets. If, for example, there are components present in the tablets which have adverse effects on each other, then it is possible to integrate one component into the quicker-dissolving layer and the other component into a slower-dissolving layer, so that the first component has already reacted when the second passes into solution. The layer structure of the tablets may be realized in stack form, in which case dissolution of the inner layer(s) at the edges of the tablet takes place at a point when the outer layers have not yet fully dissolved; alternatively, the inner layer(s) may also be completely enveloped by the respective outerlying layer(s), which prevents premature dissolution of constituents of the inner layer(s).

In one further-preferred embodiment of the invention, a tablet consists of at least three layers, i.e., two outer and at least one inner layer, with at least one of the inner layers comprising a peroxy bleach, while in the stack-form tablet the two outer layers, and in the case of the envelope-form tablet the outermost layers, are free from peroxy bleach. Furthermore, it is also possible to provide spatial separation of peroxy bleach and any bleach activators and/or enzymes present in a tablet. Multilayer tablets of this kind have the advantage that they can be used not only by way of a dispenser drawer or by way of a dosing device which is placed into the washing liquor; instead, in such cases it is also possible to place the tablet into the machine in direct contact with the textiles without fear of spotting by bleaches and the like.

In addition to the layer structure, multiphase tablets may also be produced in the form of ring/core tablets, inlay tablets, or what are known as bulleye tablets. An overview of such embodiments of multiphase tablets is described in EP 055 100 (Jeyes Group). That document discloses toilet cleaning blocks comprising a formed body comprising a slow-dissolving cleaning product composition, into which a bleach tablet has been embedded. The document at the same time discloses a wide variety of design forms of multiphase tablets, ranging the simple multiphase tablet through to complex multilayer systems with inlays.

After compression, the laundry detergent and cleaning product tablets possess high stability. The fracture strength of cylindrical tablets can be gaged by way of the parameter of diametral fracture stress. This diametral fracture stress can be determined by $$\sigma = \frac{2P}{\pi D t}$$

where σ represents the diametral fracture stress (DFS) in Pa, P is the force in N which leads to the pressure exerted on the tablet that causes it to fracture, D is the tablet diameter in meters, and t is the tablet height.

Preferred production processes for laundry detergent tablets start from granules comprising surfactant which are processed with further processing components to form a particulate premix for compression. Entirely in analogy to the above remarks concerning preferred ingredients of the laundry detergent and cleaning product tablets of the invention, the use of further ingredients is also to be transferred to their preparation. In preferred processes, the particulate premix further comprises one or more types of granules comprising surfactant and has a bulk density of at least 500 g/l, preferably at least 600 g/l, and in particular at least 700 g/l.

In preferred processes of the invention, the granules comprising surfactant have particle sizes of between 100 and 2000 μm, preferably between 200 and 1800 μm, with particular preference between 400 and 1600 μm, and in particular between 600 and 1400 μm.

The further ingredients of laundry detergent and cleaning product tablets as well may be introduced into the tablets, reference being made to the above remarks. Preferably the particulate premix described further comprises one or more substances from the group consisting of bleaches, bleach activators, disintegration aids, enzymes, pH modifiers, fragrances, perfume carriers, fluorescers, dyes, foam inhibitors, silicone oils, antiredeposition agents, optical brighteners, graying inhibitors, color transfer inhibitors, and corrosion inhibitors.

The second step of the process in accordance with the invention, comprises applying the coating.

One preferred embodiment of the present invention is depicted in the attached figure. It shows a section through a coating installation in which the process of the invention can be conducted.

The base tablets A are transported on a conveyor belt, which in the embodiment depicted here is a lattice, through the installation in direction B. A rotating roller C generates a surge of the coating material D, which is forced from below through the lattice. As a result the underside and possibly also parts of the sides of the base tablet are coated. To coat the top face and also the side parts of the base tablets the tablet is passed further through one or more mists E of coating material. In the embodiment depicted here the mists E are generated by pumping the coating material from the reservoir F via a suitable distributor G. The thickness of the coating can be regulated by fans, which can be mounted downstream of the mist. A fan is not depicted in the attached figure. It is also possible to adjust the thickness and nature of the applied coating by means of vibratory devices and special lick shafts, i.e., rotating shafts which remove excess material.

In a further embodiment the thickness of the coating can be adjusted by the amount of material running off. In the embodiment depicted here a slide valve H which is adjustable tangentially in the direction of the roller C serves for adjusting the outgoing flow of material.

After passing through the coating operation the tablets can be subjected to a drying and/or cooling step.

EXAMPLES

For producing uncoated laundry detergent and cleaning product tablets surfactant granules were mixed with further formulating components and the mixture was compressed to tablets on an excentric tableting press. The composition of the surfactant granules is indicated in Table 1 below, while the composition of the premix for compression (and thus the composition of the tablets) can be found in Table 2.

TABLE 1

| Surfactant granules [% by weight] | |
|---|---|
| $C_{9-13}$ alkylbenzenesulfonate | 18.4 |
| $C_{12-18}$ fatty alcohol sulfate | 4.9 |
| $C_{12-18}$ fatty alcohol with 7 EO | 4.9 |
| Soap | 1.6 |
| Sodium carbonate | 18.8 |
| Sodium silicate | 5.5 |
| Zeolite A (anhydrous active substance) | 31.3 |
| Optical brightener | 0.3 |
| Na hydroxyethane-1,1-diphosphonate | 0.8 |
| Acrylic acid-maleic acid copolymer | 5.5 |
| Water, salts | Remainder |

TABLE 2

| Premix [% by weight] | |
|---|---|
| Surfactant granules | 62.95 |
| Sodium perborate monohydrate | 17.00 |
| Tetraacetylethylenediamine | 7.30 |
| Foam inhibitor | 3.50 |
| Enzymes | 1.70 |
| Repel-O-Tex ® SRP 4* | 1.10 |
| Perfume | 0.45 |
| Zeolite A | 1.00 |
| Cellulose | 5.00 |

**Terephthalic acid/ethylene glycol/polyethylene glycol ester (Rhodia, Rhône-Poulenc)

For the determination of the abrasion stability 3 tablets in each case were shaken on a 1.6 mm sieve using an analytical sieving machine AS 20 from Retsch with an amplitude of 1.0 mm for one minute with no pause.

Before and after shaking, the tablets were weighed. The difference between the initial weight of the tablet and the weight after vibration gives the absolute abrasion, which is converted to percent, percent abrasion=((initial weight−weight after shaking)×100)/initial weight.

The tabletable premix was compressed to tablets (diameter: 44 mm, height: 22 mm, weight: 37.5 g) in a Korsch excentric press.

The detergent laundry detergent and cleaning product produced in this way were coated on a Microcoter coating machine from Sollich, Bad Salzuflen. The tablets were weighed before and after coating.

5 tablets produced as described above, with a weight of 38.0 g, were coated with a polymer melt comprising a copolymer comprising PEG and polyvinyl acetate.

The melt had a temperature of 70° C. and the installation as well was conditioned at 70° C.

Stable, fully coated detergent tablets were obtained with 2 g of coating on average.

The tablets obtained were investigated for their abrasion stability. An abrasion of from 1.3 to 2.5% was obtained, whereas in the case of uncoated tablets the abrasion was between 4.2 and 9.8%.

In analogy to Example 1, 5 laundry detergent tablets were coated with a 25% strength solution of polyvinyl alcohol (Moviol® 4-88, Klariant) in water. The installation was conditioned at 60° C. After coating, the tablets were dried at 80° C. for 4 minutes.

Stable, fully coated laundry detergent tablets were obtained with a coating of 0.6 g.

The abrasion of the tablets was between 0 and 0.25%.

What is claimed is:

1. A process for coating laundry detergent or cleaning product tablets that comprise builder(s) and also, if desired, further laundry detergent and cleaning product ingredients, said process comprising the steps of transporting the tablets at a speed in a conveying plane on a conveyor belt provided with a multiplicity of apertures and forcing coating material through the conveyor belt apertures from below with a force such that the coating material forced over the conveying plane forms a surge through which the tablets are transported and wherein the coating material is applied in the form of a solution or dispersion or in the form of a melt.

2. The process of claim 1, wherein the tablets additionally pass through a mist of coating material.

3. The process of claim 1, wherein the surge or coating material lifts the tablets from the conveyor belt.

4. The process of claim 1, wherein the surge is generated by a roller which rotates in the coating material, the movement of the surge being generated in the direction of the conveying direction of the tablets.

5. The process of claim 4, wherein return flow of the coating material is adjusted by way of a slide valve which is adjustable tangentially in the direction of the roller.

6. The process of claim 1, wherein the surge has a speed on emergence from the apertures that is approximately the same as the speed of the conveyor belt.

7. The process of claim 1, wherein the coating material comprises water-soluble and/or meltable polymers or polymer mixtures.

8. The process of claim 7, wherein the polymers or polymer mixtures comprise one or more of:

a) water-soluble nonionic polymers selected from the group consisting of a1) polyvinylpyrrolidones a2) vinylpyrrolidone-vinyl ester copolymers a3) cellulose ethers a4) homopolymers of vinyl alcohol, copolymers of vinyl alcohol with copolymerizable monomers, or hydrolysis products of vinyl ester homopolymers or vinyl ester copolymers with copolymerizable monomers b) water-soluble amphoteric polymers selected from the group consisting of b1) alkylacrylamide-acrylic acid copolymers b2) alkylacrylamide-methacrylic acid copolymers b3) alkylacrylamide-methylmethacrylic acid copolymers b4) alkylacrylamide-acrylic acid-alkylaminoalkyl-(meth) acrylic acid copolymers b5) alkylacrylamide-methacrylic acid-alkylamino-alkyl (meth)acrylic acid copolymers b6) alkylacrylamide-methylmethacrylic acid-alkylaminoalkyl(meth)acrylic acid copolymers b7) alkylacrylamide-alkyl methacrylate-alkylaminoethyl methacrylate-alkyl methacrylate copolymers b8) copolymers of b8i) unsaturated carboxylic acids b8ii) cationically derivatized unsaturated carboxylic acids b8iii) if desired, further ionic or nonionic monomers c) water-soluble zwitterionic polymers selected from the group consisting of c1) acrylamidoalkyltrialkylammonium chloride-acrylic acid copolymers and their alkali metal and ammonium salts c2) acrylamidoalkyltrialkylammonium chloride-methacrylic acid copolymers and their alkali metal and ammonium salts c3) methacroylethyl betaine-methacrylate copolymers d) water-soluble anionic polymers selected from the group consisting of d1) vinyl acetate-crotonic acid copolymers d2) vinylpyrrolidone-vinyl acrylate copolymers d3) acrylic acid-ethyl acrylate-N-tert-butylacrylamide terpolymers d4) graft polymers of vinyl esters, esters of acrylic acid or methacrylic acid alone or in a mixture, copolymerized with crotonic acid, acrylic acid or methacrylic acid with poly-alkylene oxides and/or polyalkylene glycols d5) grafted and crosslinked copolymers from the copolymerization of d5i) at least one monomer of the nonionic type, d5ii) at least one monomer of the ionic type, d5iii)polyethylene glycol, and d5iv) a crosslinker d6) copolymers obtained by copolymerizing at least one monomer from each of the three following groups:

d6i) esters of unsaturated alcohols and short-chain saturated carboxylic acids and/or esters of short-chain saturated alcohols and unsaturated carboxylic acids, d6ii) unsaturated carboxylic acids, d6iii) esters of long-chain carboxylic acids and unsaturated alcohols and/or esters of the carboxylic acids of group d6ii) with saturated or unsaturated, straight-chain or branched $C_{8-18}$ alcohol d7) graft copolymers obtainable by grafting d7i) polyalkylene oxides with d7ii) vinyl acetate d8) terpolymers of crotonic acid, vinyl acetate and an allyl or methallyl ester d9) tetra- and pentapolymers of d9i) crotonic acid or allyloxyacetic acid d9ii) vinyl acetate or vinyl propionate d9iii) branched allyl or methallyl esters d9iv) vinyl ethers, vinyl esters or straight-chain allyl or methallyl esters d10) crotonic acid copolymers with one or more monomers from the group consisting of ethylene, vinylbenzene, vinyl methyl ether, acrylamide and water-soluble salts thereof d11) terpolymers of vinyl acetate, crotonic acid and vinyl esters of a saturated aliphatic $\alpha$-branched monocarboxylic acid e) water-soluble cationic polymers selected from the group consisting of e1) quaternized cellulose derivatives e2) polysiloxanes with quaternary groups e3) cationic guar derivatives e4) polymeric dimethyldiallylammonium salts and their copolymers with esters and amides of acrylic acid and methacrylic acid e5) copolymers of vinylpyrrolidone with quaternized derivatives of dialkylaminoacrylate and -methacrylate e6) vinylpyrrolidone-methoimidazolinium chloride copolymers e7) quaternized polyvinyl alcohol e8) polymers indicated under the INCI designations Polyquaternium 2, Polyquaternium 17, Polyquaternium 18, and Polyquaternium 27 f) polyurethanes g) lower critical separation temperature (LCST) polymers, preferably alkylated and/or hydroxyalkylated polysaccharides, cellulose ethers, acrylamides, such as polyisopropylacrylamide, copolymers of acrylamides, polyvinylcaprolactam, copolymers of polyvinylcaprolactam, particularly those with polyvinylpyrrolidone, polyvinyl methyl ether, copolymers of polyvinyl methyl ether, and blends of these substances.

9. The process of claim 1, wherein the coating material has a temperature of from 30 to 300° C.

10. The process of claim 1, wherein the coating material is applied in the form of an aqueous solution or dispersion, and the tablets are subsequently subjected to a drying step.

11. The process of claim 1, wherein the weight ratio of uncoated tablet to coating is >10:1.

12. The process of claim 1, wherein the thickness of the coating on the tablet is from 0.1 to 500 $\mu$m.

13. The process of claim 1, wherein the coating additionally comprises substances selected from the groups consisting of disintegration aids, dyes, optical brighteners, fragrances, enzymes, bleaches, bleach activators, silver protectants, complexing agents, surfactants, graying inhibitors, and mixtures thereof in total amounts of from 0.5 to 30% by weight based on the weight of the coating.

14. The process of claim 9, wherein the coating has a temperature of from 35 to 90° C.

15. The process of claim 14, wherein the coating has a temperature of from 40 to 85° C.

16. The process of claim 15, wherein the coating has a temperature of from 50 to 80° C.

17. The process of claim 11, wherein the weight ratio of uncoated tablet to coating is >25:1.

18. The process of claim 17, wherein the weight ratio of uncoated tablet to coating is >50:1.

19. The process of claim 12, wherein the thickness of the coating on the tablet is from 0.5 to 250 $\mu$m.

20. The process of claim 19, wherein the thickness of the coating on the tablet is from 5 to 100 $\mu$m.

21. The process of claim 13, wherein the coating is present in total amounts of from 1 to 20% by weight based on the weight of the coating.

22. The process of claim 21, wherein the coating is present in total amounts of from 2.5 to 10% by weight, based on the weight of the coating.

* * * * *